US007412791B2

(12) United States Patent
Bradley et al.

(10) Patent No.: US 7,412,791 B2
(45) Date of Patent: Aug. 19, 2008

(54) ADJUSTABLE MENU PANEL

(75) Inventors: James E. Bradley, Independence, KY (US); Donald E. Lunnemann, Florence, KY (US); Robert Uzzolino, Burlington, KY (US)

(73) Assignee: LSI Industries, Inc., Cincinnati, OH (US)

( * ) Notice: Subject to any disclaimer, the term of this patent is extended or adjusted under 35 U.S.C. 154(b) by 200 days.

(21) Appl. No.: 11/018,747

(22) Filed: Dec. 20, 2004

(65) Prior Publication Data

US 2006/0130383 A1 Jun. 22, 2006

(51) Int. Cl.
*G09F 13/04* (2006.01)

(52) U.S. Cl. ..... 40/611.06; 40/574; 40/568; 40/576; 40/618

(58) Field of Classification Search ..... 40/606.14, 40/611.03–611.08, 618, 576, 574, 606–14
See application file for complete search history.

(56) References Cited

U.S. PATENT DOCUMENTS

| | | | | |
|---|---|---|---|---|
| 99,675 | A | 2/1870 | Howell | |
| 193,066 | A | 7/1877 | La France | |
| 302,723 | A | 7/1884 | Grimes | |
| 361,973 | A | 4/1887 | Warner | |
| 449,464 | A | 3/1891 | Cook | |
| 574,815 | A | 1/1897 | McCelland | |
| 650,059 | A | 5/1900 | Almonte | |
| 690,934 | A | 1/1902 | Dick | |
| 786,610 | A | 4/1905 | Terry | |
| 843,889 | A | 2/1907 | Gilman et al. | |
| 853,129 | A | 5/1907 | Simpson | |
| 947,828 | A | 2/1910 | Lennox | |
| 956,425 | A | 4/1910 | Rothschild | |
| 959,896 | A | 5/1910 | Staren | |
| 1,008,260 | A | 11/1911 | Harris | |
| 1,071,226 | A | 8/1913 | Goodsell et al. | |
| 1,120,876 | A | 12/1914 | Witz | 40/576 |

(Continued)

FOREIGN PATENT DOCUMENTS

| | | |
|---|---|---|
| AU | A 52473/96 | 11/1997 |

(Continued)

OTHER PUBLICATIONS

Webpage: www.s2k.com.au/pages/system_ams.htm, Sep. 16, 2003; , S2K Identity Systems—Aluminum Modular Signage-Architecturall Modular Systems,Sep. 16, 2003; 1 pg.

(Continued)

*Primary Examiner*—Lesley D. Morris
*Assistant Examiner*—Shin Kim
(74) *Attorney, Agent, or Firm*—McDermott Will & Emery LLP

(57) ABSTRACT

A menu panel for supporting elongated menu strips of varying heights is disclosed having adjustable guide rails supported by a frame. The frame includes vertical side frame members incorporating guide rail locating elements disposed along the length of the vertical side frame members to position the guide rails. The guide rails are selectively positionable along the length of the vertical side frame members to provide adjustable spacing between adjacent pairs of guide rails. The menu strips include descriptive indicia such as product names and pricing information and are disposed between and supported by adjacent pairs of the guide rails.

43 Claims, 9 Drawing Sheets

U.S. PATENT DOCUMENTS

| | | | | |
|---|---|---|---|---|
| 1,182,952 | A | 5/1916 | Wilke | |
| 1,188,154 | A | 6/1916 | Cross | |
| 1,203,368 | A | 10/1916 | Lee | |
| 1,258,146 | A | 3/1918 | Russell | |
| 1,347,012 | A | 7/1920 | Colony | |
| 1,349,396 | A | 8/1920 | Van Clief | |
| 1,355,716 | A | 10/1920 | Trevail | |
| 1,400,438 | A | 12/1921 | Jaquette | 40/618 |
| 1,402,075 | A | 1/1922 | Kolk | |
| 1,414,536 | A | 5/1922 | Webster et al. | |
| 1,447,918 | A | 3/1923 | Zacher | |
| 1,523,976 | A | 1/1925 | Meyer | |
| 1,644,742 | A | 10/1927 | Moynihan | |
| 1,678,240 | A | 7/1928 | Benz | |
| 1,686,994 | A | 10/1928 | Thompson | |
| 1,747,400 | A | 2/1930 | Stewart et al. | |
| 1,762,685 | A | 6/1930 | Hartman | |
| 1,775,725 | A | 9/1930 | Keith | |
| 1,788,468 | A | 1/1931 | Mentink | |
| 1,799,190 | A | 4/1931 | Wilson | |
| 1,807,649 | A | 6/1931 | Brown | |
| 1,809,804 | A | 6/1931 | Rider | 40/585 |
| 1,812,715 | A | 6/1931 | Quillin et al. | |
| 1,825,900 | A | 10/1931 | England | |
| 1,831,228 | A | 11/1931 | Clark | |
| 1,834,423 | A | 12/1931 | Rider | 40/585 |
| 1,841,026 | A | 1/1932 | Greenstone | |
| 1,847,815 | A | 3/1932 | Church | |
| 1,858,208 | A | 5/1932 | Ingersoll | |
| 1,887,591 | A | 11/1932 | Fugita | 40/618 |
| 1,913,585 | A | 6/1933 | Crosby | |
| 1,973,983 | A | 9/1934 | Henning | |
| 2,001,115 | A | 5/1935 | Shaw | |
| 2,006,573 | A | 7/1935 | Isenhour | 40/63 |
| 2,033,478 | A | 3/1936 | Martinez | |
| 2,079,230 | A | 5/1937 | Shively | 40/133 |
| 2,080,379 | A | 5/1937 | Reiter | |
| 2,092,508 | A | 9/1937 | Hammar | |
| 2,109,643 | A | 3/1938 | Kehl | |
| 2,122,153 | A | 6/1938 | Page | |
| 2,134,037 | A | 10/1938 | Fenton | |
| 2,160,886 | A | 6/1939 | McCombs | |
| 2,170,985 | A | 8/1939 | Buras | |
| 2,204,868 | A | 6/1940 | Russell et al. | |
| 2,272,733 | A | 2/1942 | Wamser | 40/130 |
| 2,313,723 | A | 3/1943 | Adler | 40/140 |
| 2,319,910 | A | 5/1943 | Adler | |
| 2,328,648 | A | 9/1943 | Jansson | |
| 2,492,311 | A | 12/1949 | Moro | |
| 2,501,084 | A | 3/1950 | Ownbey | |
| 2,515,664 | A | 7/1950 | Padgett | |
| 2,519,299 | A | 8/1950 | Vanderzee | |
| 2,541,460 | A | 2/1951 | Bugh | |
| 2,541,632 | A | 2/1951 | Baugh | |
| 2,547,049 | A | 4/1951 | Seep | |
| 2,552,764 | A | 5/1951 | Bedford, Jr. | |
| 2,559,106 | A | 7/1951 | Bishop et al. | 40/125 |
| 2,561,813 | A | 7/1951 | Murphy | 40/140 |
| 2,587,368 | A | 2/1952 | Murphy | |
| 2,615,268 | A | 10/1952 | Hamilton | |
| 2,615,380 | A | 10/1952 | Murphy | 95/73 |
| 2,632,271 | A | 3/1953 | Nigg | |
| 2,649,797 | A | 8/1953 | O'Gorman | |
| 2,649,798 | A | 8/1953 | Bustamante | |
| 2,847,782 | A | 8/1958 | Muse | |
| 2,869,263 | A | 1/1959 | Dillen | |
| 2,876,560 | A | 3/1959 | Henley | |
| 2,946,612 | A | 7/1960 | Ahlgren | |
| 2,976,634 | A | 3/1961 | Ashley | |
| 3,061,340 | A | 10/1962 | Fernberg | |
| 3,071,252 | A | 1/1963 | Hanschar | |
| 3,088,184 | A | 5/1963 | Bittner | |
| 3,159,937 | A | 12/1964 | Barnes | |
| 3,175,318 | A | 3/1965 | Bayer | |
| 3,269,763 | A | 8/1966 | Ahlgren | |
| 3,310,901 | A | 3/1967 | Sarkisian | |
| 3,348,038 | A | 10/1967 | Jacobs | |
| 3,349,738 | A | 10/1967 | Kish, Jr. | |
| 3,395,472 | A | 8/1968 | Look | |
| 3,407,525 | A | 10/1968 | Connell | |
| 3,419,979 | A | 1/1969 | McVicker et al. | 40/64 |
| 3,479,985 | A | 11/1969 | Morley | |
| 3,531,884 | A | 10/1970 | Adler | |
| 3,595,380 | A | 7/1971 | Miller | |
| 3,601,917 | A | 8/1971 | Shankman | |
| 3,616,556 | A | 11/1971 | Williams | |
| 3,650,055 | A | 3/1972 | Bult, III | |
| 3,673,720 | A | 7/1972 | Thornton | 40/125 R |
| 3,680,525 | A | 8/1972 | Berge | 116/135 |
| 3,680,927 | A | 8/1972 | Neureuther | |
| 3,685,186 | A | 8/1972 | Goodman | |
| 3,734,551 | A | 5/1973 | Hughes et al. | |
| 3,742,633 | A | 7/1973 | Palm | |
| 3,780,458 | A | 12/1973 | Jacoby et al. | |
| 3,831,895 | A | 8/1974 | Schubert | 248/475 R |
| 3,866,374 | A | 2/1975 | Dallen | |
| 3,905,139 | A | 9/1975 | Cooper | |
| 3,919,794 | A | 11/1975 | Hunter | |
| 3,939,584 | A | 2/1976 | Trame | |
| 3,943,646 | A | 3/1976 | Branham | |
| 3,946,877 | A | 3/1976 | Galicia | |
| 3,961,434 | A | 6/1976 | Sampon | |
| 3,984,191 | A | 10/1976 | Doty | |
| 4,015,388 | A | 4/1977 | Hemminger | |
| 4,025,015 | A | 5/1977 | Kolic | |
| 4,047,314 | A | 9/1977 | Slack et al. | |
| 4,048,738 | A | 9/1977 | McHenry | |
| 4,056,275 | A | 11/1977 | Keeler, II | |
| 4,095,359 | A | 6/1978 | Trame | |
| 4,132,020 | A | 1/1979 | Nidelkoff | 40/606 |
| 4,134,182 | A | 1/1979 | Ramsby | |
| 4,134,499 | A | 1/1979 | Joswig | |
| 4,138,787 | A | 2/1979 | Sarkisian | |
| 4,145,828 | A | 3/1979 | Hillstrom | 40/156 |
| 4,201,002 | A | 5/1980 | Barton | |
| 4,229,894 | A | 10/1980 | Beck | |
| 4,237,635 | A | 12/1980 | Paraghamian et al. | |
| 4,253,171 | A | 2/1981 | Grinwald | |
| 4,258,490 | A | 3/1981 | Trame | |
| 4,292,752 | A | 10/1981 | Clark | |
| 4,333,255 | A | 6/1982 | Ward | |
| 4,345,396 | A | 8/1982 | Janssen | 40/490 |
| 4,364,616 | A | 12/1982 | Harkins et al. | |
| 4,367,604 | A | 1/1983 | Porter, II et al. | 40/564 |
| 4,461,107 | A | 7/1984 | Grate | 40/576 |
| 4,512,098 | A | 4/1985 | Ready et al. | |
| 4,521,984 | A | 6/1985 | Murray | 40/576 |
| 4,523,402 | A | 6/1985 | Dobson | |
| D279,585 | S | 7/1985 | Seggerson et al. | |
| D279,587 | S | 7/1985 | Seggerson et al. | |
| 4,542,605 | A | 9/1985 | Gandy | |
| 4,553,345 | A | 11/1985 | Bercier et al. | |
| 4,577,428 | A | 3/1986 | Trame | |
| 4,584,737 | A | 4/1986 | Ohman | |
| 4,604,820 | A | 8/1986 | Edman | |
| 4,626,046 | A | 12/1986 | Collins, Jr. | |
| 4,642,859 | A | 2/1987 | Kaiser | |
| 4,653,209 | A | 3/1987 | Cobb | |
| 4,669,156 | A | 6/1987 | Guido et al. | |
| 4,669,210 | A | 6/1987 | Van Erum | |
| 4,672,757 | A | 6/1987 | Field | |
| 4,682,430 | A | 7/1987 | Ramsay | 40/5 |
| 4,693,026 | A | 9/1987 | Callahan et al. | |
| 4,698,881 | A | 10/1987 | Watanabe | |

| | | | | |
|---|---|---|---|---|
| 4,707,938 | A | 11/1987 | Carssow | |
| 4,718,543 | A | 1/1988 | Leisner et al. | |
| 4,753,026 | A | 6/1988 | Woodman et al. | |
| 4,802,296 | A | 2/1989 | Kovalak, Jr. | 40/607 |
| 4,817,316 | A | 4/1989 | Walker | |
| 4,827,644 | A | 5/1989 | Trame | |
| 4,868,956 | A | 9/1989 | Shepard | |
| 4,965,947 | A | 10/1990 | Zanetti | |
| 4,991,332 | A | 2/1991 | Brüssing | |
| 4,991,334 | A | 2/1991 | Amundesen | |
| 5,009,258 | A | 4/1991 | Fraser | |
| 5,012,603 | A | 5/1991 | Elcock | |
| 5,022,172 | A | 6/1991 | Kawahara et al. | |
| 5,029,406 | A | 7/1991 | Hoffman | |
| 5,044,104 | A | 9/1991 | Hopperdietzel | |
| 5,088,221 | A * | 2/1992 | Bussiere et al. | 40/618 |
| 5,101,541 | A | 4/1992 | Watanabe | |
| 5,138,781 | A | 8/1992 | Claver | |
| 5,174,055 | A | 12/1992 | Aiken | |
| 5,207,490 | A | 5/1993 | Kaspar et al. | |
| 5,224,610 | A | 7/1993 | Veazey | |
| 5,241,467 | A | 8/1993 | Failing et al. | |
| 5,241,767 | A | 9/1993 | Fuda et al. | |
| 5,263,269 | A | 11/1993 | Tjärnlund | |
| 5,265,363 | A | 11/1993 | Martin | |
| 5,347,736 | A | 9/1994 | Kanigan | 40/576 |
| 5,392,546 | A | 2/1995 | Bailey | |
| 5,394,996 | A | 3/1995 | Carpenter | |
| 5,410,830 | A | 5/1995 | Aiken, Sr. | |
| 5,487,231 | A | 1/1996 | Grate | |
| 5,542,202 | A | 8/1996 | Brugger | 40/576 |
| 5,588,238 | A | 12/1996 | Visocky et al. | 40/618 |
| 5,636,463 | A | 6/1997 | Sharon et al. | 40/618 |
| 5,682,694 | A | 11/1997 | Hillstrom | 40/574 |
| 5,687,498 | A | 11/1997 | Keyser et al. | 40/518 |
| 5,901,486 | A * | 5/1999 | Sharon et al. | 40/618 |
| 5,930,926 | A | 8/1999 | Kaplan | |
| 5,933,990 | A | 8/1999 | Keyser et al. | |
| 5,983,543 | A | 11/1999 | Hillstrom | 40/574 |
| 6,105,290 | A | 8/2000 | Coates et al. | 40/518 |
| 6,125,565 | A | 10/2000 | Hillstrom | 40/574 |
| 6,298,589 | B1 | 10/2001 | Hillstrom | 40/574 |
| 6,631,576 | B2 | 10/2003 | Hillstrom | 40/574 |
| 6,843,011 | B2 * | 1/2005 | Hillstrom | 40/574 |

FOREIGN PATENT DOCUMENTS

| | | |
|---|---|---|
| CA | 0312910 | 6/1931 |
| CA | 0317179 | 11/1931 |
| CA | 0338766 | 1/1934 |
| CA | 0394901 | 3/1941 |
| CA | 0487536 | 10/1952 |
| CA | 0581751 | 4/1959 |
| CA | 0626686 | 9/1961 |
| CA | 750111 | 1/1967 |
| CA | 0988298 | 5/1976 |
| CA | 1111246 | 10/1981 |
| CA | 1252293 | 4/1989 |
| CA | 2062330 | 3/1992 |
| CA | 2105943 | 9/1993 |
| CA | 2131976 | 6/1995 |
| CA | 2135862 | 2/1996 |
| CA | 2131983 | 3/1996 |
| DE | 1056913 | 3/1913 |
| DE | 0558336 | 9/1932 |
| DE | 189277 | 2/1937 |
| DE | 2829434 | 1/1980 |
| DE | 3239349 | 4/1984 |
| DE | 3313914 | 10/1984 |
| DE | 8618828.3 | 8/1986 |
| DE | 8709661.3 | 12/1987 |
| DE | 3817618 | 5/1989 |
| DE | 4422233 | 1/1995 |
| DE | 4428395 | 2/1996 |
| EP | 0011385 | 5/1880 |
| EP | 0024774 | 3/1981 |
| EP | 0079148 | 5/1983 |
| EP | 0107801 | 5/1984 |
| EP | 0114453 A1 | 8/1984 |
| EP | 0192491 A2 | 8/1986 |
| EP | 0211088 | 2/1987 |
| EP | 0233438 | 8/1987 |
| EP | 0288996 A2 | 11/1988 |
| EP | 0328204 A1 | 8/1989 |
| EP | 0341087 | 11/1989 |
| EP | 0383427 | 8/1990 |
| EP | 0383427 A2 | 8/1990 |
| EP | 0445569 | 9/1991 |
| EP | 0509159 A1 | 10/1992 |
| EP | 0545039 | 6/1993 |
| EP | 0564657 A1 | 10/1993 |
| EP | 0598288 | 5/1994 |
| EP | 0613112 | 8/1994 |
| EP | 0638889 A1 | 2/1995 |
| EP | 0642754 | 3/1995 |
| EP | 1056913 | 12/2000 |
| EP | 1111246 | 6/2001 |
| FR | 0571629 | 5/1924 |
| FR | 1327200 | 4/1963 |
| FR | 2159993 | 6/1973 |
| FR | 2382729 | 9/1978 |
| FR | 2404882 | 4/1979 |
| FR | 2463961 | 2/1981 |
| FR | 2673309 | 8/1992 |
| GB | 0318014 | 8/1929 |
| GB | 0357544 | 9/1931 |
| GB | 0361973 | 11/1931 |
| GB | 0390614 | 4/1933 |
| GB | 0465800 | 5/1937 |
| GB | 0651180 | 3/1951 |
| GB | 0816858 | 9/1955 |
| GB | 0816858 | 7/1959 |
| GB | 876899 | 9/1961 |
| GB | 876900 | 9/1961 |
| GB | 0927208 | 5/1963 |
| GB | 1183305 | 3/1970 |
| GB | 2052124 | 1/1981 |
| GB | 2217501 | 10/1989 |
| GB | 2226681 | 4/1990 |
| IT | 0651180 | 1/1963 |
| JP | 60-227289 | 1/1985 |
| JP | 60-227289 | 11/1985 |
| JP | 3-73992 | 1/1991 |
| JP | 3-73992 | 3/1991 |
| NL | 0001467 | 9/1916 |
| WO | WO/83/02516 | 7/1983 |
| WO | WO/92/13157 | 8/1992 |
| WO | WO 01/53462 | 7/2001 |

OTHER PUBLICATIONS

Webpage: http://www.s2k.com.au/photos/01.jpg, Sep. 16, 2003, 1 page.
Webpage: Bita Page Links, EMC Solder Pallets, EMC Global Technologies, Inc, Sep. 9, 2003, 2 pgs.
Photos: Signage Boards, 5 pgs.
U.S. Appl. No. 07/966,382, filed Oct. 1992, William Timmerding et al.
Brochure: Arby's Drive-Thru Menu Board Systems.
Brochure: Arby's Interior Menu Board Systems.
Brochure: Arby's Dual Brand Menu Boards.
Brochure: Popeyes Chicken & Biscuit Menu Board Program.
Brochure: Popeyes Chicken & Biscuits Menu Board Program.
Brochure: Popeyes Chicken & Biscuits: Adjustable Track Panel.
Photos: Menuboard.
Brochure: Drive-Thru and Interior Menu Board Program.

Brochure: Wolfe Merchandising Panel: KFC International Drive-Thru Menu-Board System.
Brochure: Wolf Merchandising MBS 2.
Photos: Wolf Merchandising MBS 2.
Breakfast Value Meal Translites to 3 Tier Sizes & Changing Front Clear Crystals to Matte (Interior), Instruction Guide, Feb. 21, 2002.
Advertising Packet: Posterloid—Black Vista Illuminated Menuboards.
Photos: Fastener 1—Black.
Photos: Fastener 2—Silver.
Photos: Fastener 3—Silver (Liberty).
Photos: Crawford Broom Clips.
Photos: Crawford Super Grip Heavy Duty Tool Holders.
Photos: Crawford Medium Grip Clips.
Photos: Crawford Spring Grips.
Photos: Crawford Spring Grips—Light Duty.
Article "There's gold in our aluminum sign system", Mar. 1980, p. 28.
Advertisement: "Slatz—The Profitmaker", No. 10 1985, p. 23.
Brochure: Mainstreet Menu Systems—Outdoor Illuminated Menu System.
Brochure: American Menu Displays—Panel-Lite Menu Board Series.
Brochure: Posterloid—Panelon Menuboard System.
Brochure: International Patterns Incorporated.
Webpage: web.archive.org/web/20031027150350/http://www.autogroup.com/adjwavepallets.htm, 2 pgs.
Webpage: web.archive.org/web/20031006081335/http://www.dmipallet.com/adjustable.html, 2 pgs.
Webpage: web.archive.org/web/20030807155322/http://www.ultimatesign.com/d2.html, 2 pgs.
Webpage: web.archive.org/web20030625041812/http://www.fancort.com/assembly.htm, 2 pgs.
Advertisement: Signs of the Times No. 16, *Slatz*, 2 pages.
Advertisement: Signs of the Times, *Slatz Spandex Sign System*, Nov. 1990, 1 pg.

* cited by examiner

ADJUSTABLE MENU PANEL

FIELD OF THE INVENTION

The present invention relates generally to menu boards and, more particularly, to menu panels for use in menu boards which utilize elongated menu strips having descriptive indicia to display menu item names and pricing information.

BACKGROUND OF THE INVENTION

Menu boards are widely used at fast food restaurants, for example, to display menu item descriptions and pricing information to a customer. Such menu boards are oftentimes used in restaurants to inform the customer of the available products, their prices, and may also include photographs of special menu items. Typically, the menu board includes one or more menu panels (also referred to as "grids") mounted to an illuminating box (also referred to as a light box) containing a light source for back-lighting the menu panels from the interior of the box.

In menu boards of the type described above, it is well known in the art to provide menu item descriptions and pricing information on elongated menu strips (also referred to as "slats") which are supported by the menu panels and positioned forwardly of the light source. The menu strips may include transparent characters or numerals which are thus illuminated by the light source while an opaque surface on the menu strip prevents light from being transmitted through other areas of the menu strip. Examples of such menu strip designs may be found in Porter, II et al., U.S. Pat. No. 4,367,604 and Grate, U.S. Pat. No. 4,461,107 wherein the menu strips are positioned on the menu board between adjacent pairs of guide rails fixed to a front or rear surface of the menu board.

It is generally common in the fast food industry to have menu strips with varying heights as different menu items require more or less description of the product. For example, one menu strip may contain the description "Hamburger" while another menu strip may describe a special combination of "Hamburger", "French Fries" and a "Drink", with these descriptions being presented in three separate lines on the menu strip to reduce customer confusion in selecting from available products. In the latter example, it will be recognized that the menu strip will have a greater height than in the former example. Moreover, the restaurant may include photographs of special menu items presented on flexible strips of varying heights which are also positioned forwardly of the light source between adjacent pairs of guide rails.

In U.S. Pat. Nos. 5,636,463 and 5,901,486, owned by the common assignee, menu panels are disclosed that are adjustable in the field to accommodate for changes in the heights of menu strips, photographs and other descriptive indicia presented at the menu board. In the adjustable menu panels of these patents, a menu panel frame is provided having a top, a bottom and a pair of side members. The side members of the frame incorporate a series of guide rail support elements disposed along the length of the side members that positively engage and secure a series of generally parallel guide rails to the frame. The guide rails are selectively engageable and disengageable at their opposite ends with the guide rail support elements to provide adjustable spacing between adjacent pairs of the guide rails. A series of elongated menu strips having descriptive indicia, such as menu item names and pricing information, are disposed between and supported by different adjacent pairs of the guide rails.

The guide rails are slotted longitudinally to slidably receive the menu strips between adjacent pairs of the guide rails. The guide rails include an "H-shaped" cross-section front member and a rearwardly extending clip member that engages the guide rail support elements and secures the guide rails to the frame. The front members thereby define a series of sleeves between adjacent pairs of the guide rails to slidably receive the menu strips within the sleeves. To accommodate for changes in menu strip height, the guide rails are selectively positionable at varying locations along the length of the side members to provide adjustable spacing between adjacent pairs of the guide rails.

Notwithstanding the advantages and benefits provided by the adjustable menu panels disclosed in U.S. Pat. Nos. 5,636,463 and 5,901,486, there is a need for an improved menu panel system which is readily adjustable for different menu board applications.

SUMMARY OF THE INVENTION

The present invention overcomes the foregoing and other shortcomings and drawbacks of adjustable menu panels heretofore known. While the invention will be described in connection with certain embodiments, it will be understood that the invention is not limited to these embodiments. On the contrary, the invention includes all alternatives, modifications and equivalents as may be included within the spirit and scope of the present invention.

The adjustable menu panel of the present invention includes a rectangular frame having a top frame member, a bottom frame member and a pair of vertical side frame members extending in spaced apart relationship between the top and bottom frame members. In one embodiment, the right side frame member includes a stationary vertical frame section and a rotatable and removable vertical frame section disposed adjacent to the stationary vertical frame section. The frame members may be readily manufactured with varying horizontal and vertical dimensions to customize the size of the frame for a particular menu board application.

According to one aspect of the present invention, a vertical array of spaced-apart guide rail locating elements is disposed along each of the side frame members. Each spaced-apart adjacent pair of the guide rail locating elements defines a locating pocket therebetween. A series of generally horizontally disposed parallel guide rails are selectively positionable in the locating pockets disposed along the side frame members at opposite ends of the guide rails. The guide rails are selectively positionable in the locating pockets at regularly and variably spaced positions vertically along the side frame members to provide the same and different spacing between adjacent pairs of the guide rails, respectively. The guide rails are configured to receive and retain menu strips within sleeves formed between adjacent pairs of the guide rails. The menu strips are back-lit from a light source positioned behind the menu panel. In this way, menu strips or photographs of varying heights can be inserted into the sleeves.

In one embodiment, the leftmost ends of the guide rails are loosely positioned within the locating pockets provided along the length of the left side frame member by inserting the leftmost ends of the guide rails laterally in a leftward direction generally parallel to a plane defined by the menu board. A front flange or lip portion provided on the left side frame member overlies the respective leftmost ends of the guide rails to partially retain the guide rails within the locating pockets disposed vertically along the length of the left side frame member.

With the removable and rotatable vertical frame section disassembled and removed from the top and bottom frame members, the respective rightmost opposite ends of the guide rails are then generally pivoted toward the stationary vertical frame section of the right side frame member so as to be loosely received within the locating pockets provided along the length of the stationary frame section of the right side frame member.

In accordance with another aspect of the present invention, the removable and rotatable vertical frame section is selectively engageable and disengageable with the top and bottom frame members adjacent to the stationary vertical frame section of the right side frame member. In its engaged position, the removable and rotatable vertical frame section overlies respective rightmost ends of the guide rails positioned within the locating pockets provided along the length of the stationary vertical frame section to retain, in conjunction with the front flange or lip portion of the left side frame member, the guide rails within the locating pockets. In the disengaged position of the rotatable and removable vertical frame section, the guide rails may be removed from the locating pockets provided along the respective lengths of the left side frame member and the stationary vertical frame section of the right side frame member. Absent disassembly and removal of the removable and rotatable vertical frame section, the guide rails cannot be inserted into or removed from the menu panel.

According to another aspect of the present invention, a locking member is connected to the frame and is selectively engageable with the rotatable and removable frame section of the right side frame member to lock the rotatable and removable frame section in its engaged position with the top and bottom frame members.

In one embodiment, the rotatable and removable frame section is pivotally connected to the top and bottom frame members so as to be pivotal between open and closed positions. Menu strips are slidably inserted into the sleeves formed between adjacent pairs of the guide rails when the rotatable and removable frame section is moved to the open position. Thereafter, the rotatable and removable frame section is moved to the closed position to retain the menu strips within the sleeves formed between the adjacent pairs of guide rails. A locking member is provided to selectively lock the rotatable and removable frame section in its closed position and thereby retain the menu strips within the sleeves.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and, together with the general description of the invention given above and the detailed description of an embodiment given below, serve to explain the principles of the present invention.

DETAILED DESCRIPTION OF THE INVENTION

Figure 1:
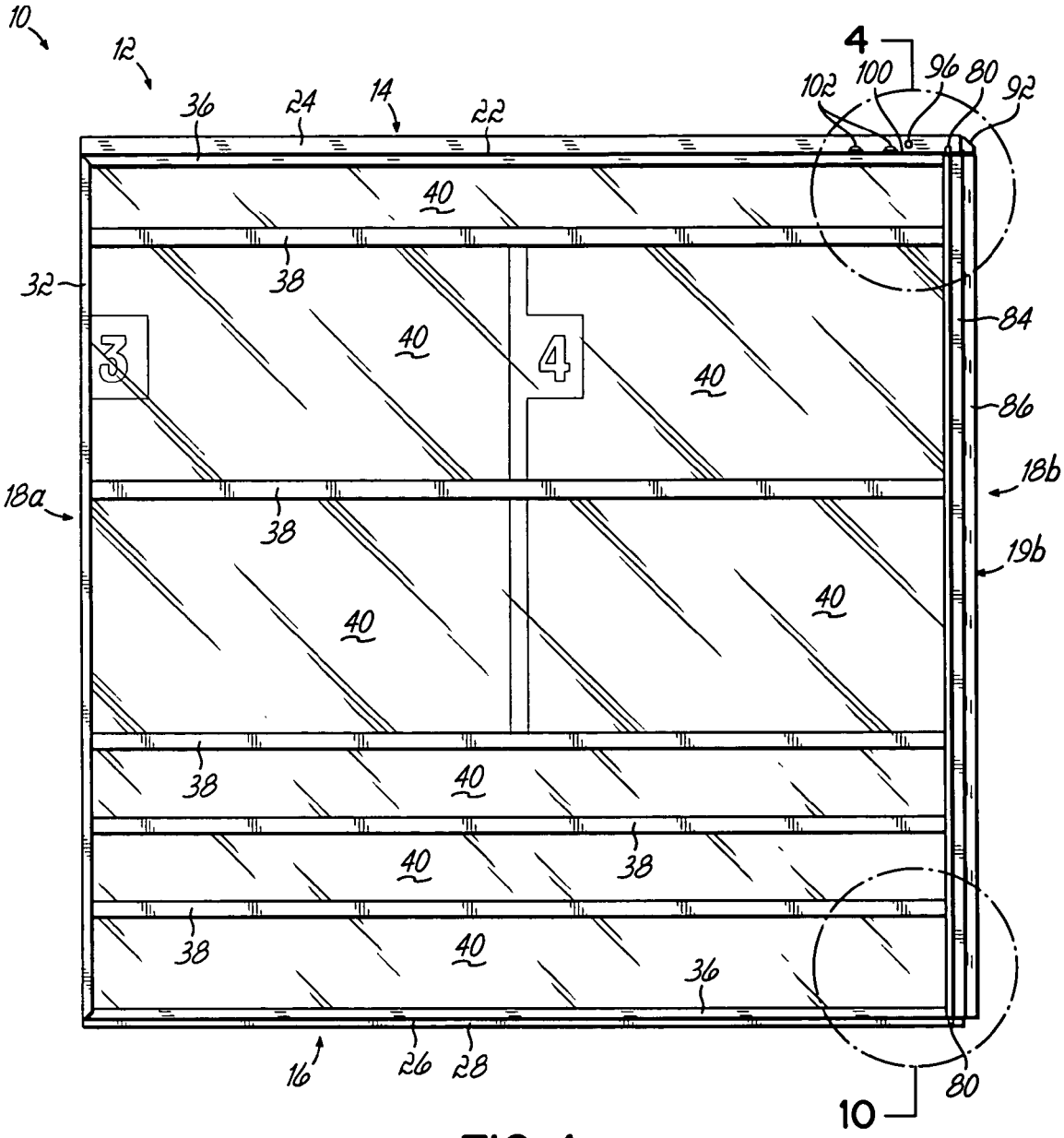
FIG. 1 is a front plan view of an adjustable menu panel according to one embodiment of the present invention.
Figure 2:
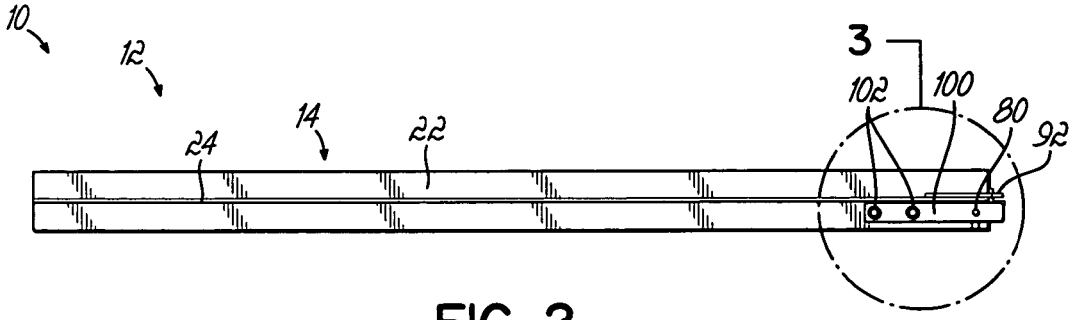
FIG. 2 is a top plan view of the adjustable menu panel of FIG. 1.

Referring now to the drawings, and to FIG. 1 in particular, an adjustable menu panel 10 is shown in accordance with the principles of the present invention. Menu panel 10 includes a rectangular frame 12 having a top frame member 14, a bottom frame member 16 and a pair of vertical side frame members 18*a* and 18*b* extending in spaced apart relationship between the top and bottom frame members 14 and 16. Side frame member 18*b* includes a stationary vertical frame section 19*a* and a rotatable and removable vertical frame section 19*b* that is disposed adjacent to the stationary vertical frame section 19*a* as will be described in greater detail below. The side frame member 18*a* and the stationary vertical frame section 19*a* of side frame member 18*b* are connected at their opposite ends to respective opposite ends of the top and bottom frame members 14, 16. The top frame member 14, bottom frame member 16, vertical side frame member 18*a* and vertical side frame member 18*b*, including the stationary vertical frame section 19*a* and the rotatable and removable vertical frame section 19*b*, form the assembled frame 12.

Figure 5:
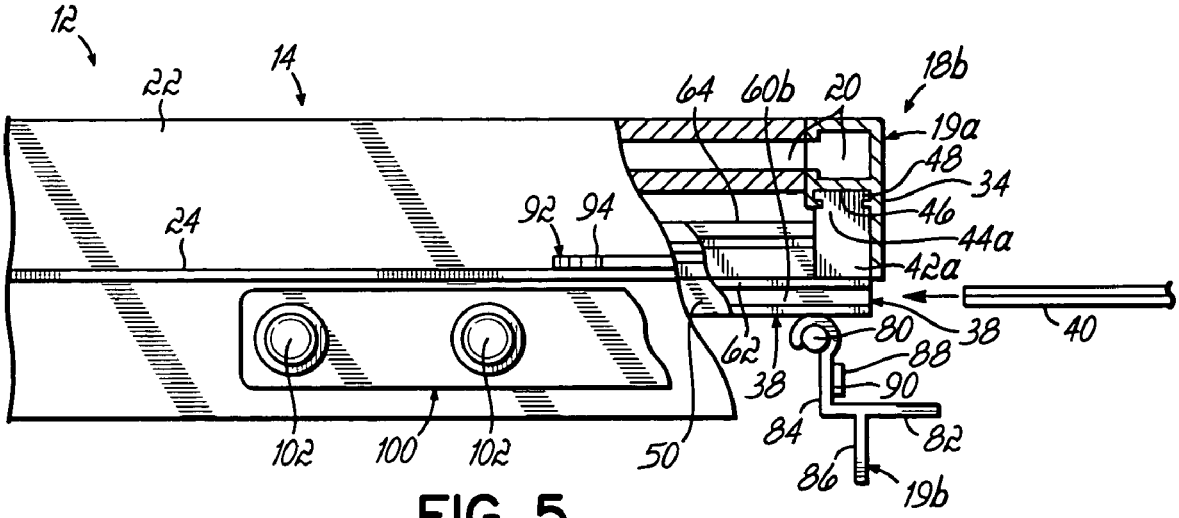
FIG. 5 is an enlarged top plan view similar to FIG. 3, showing a removable and rotatable vertical frame section of the adjustable menu panel of FIG. 1 moved to an open position and preliminary to insertion of a menu strip between an adjacent pair of guide rails.
Figure 9:
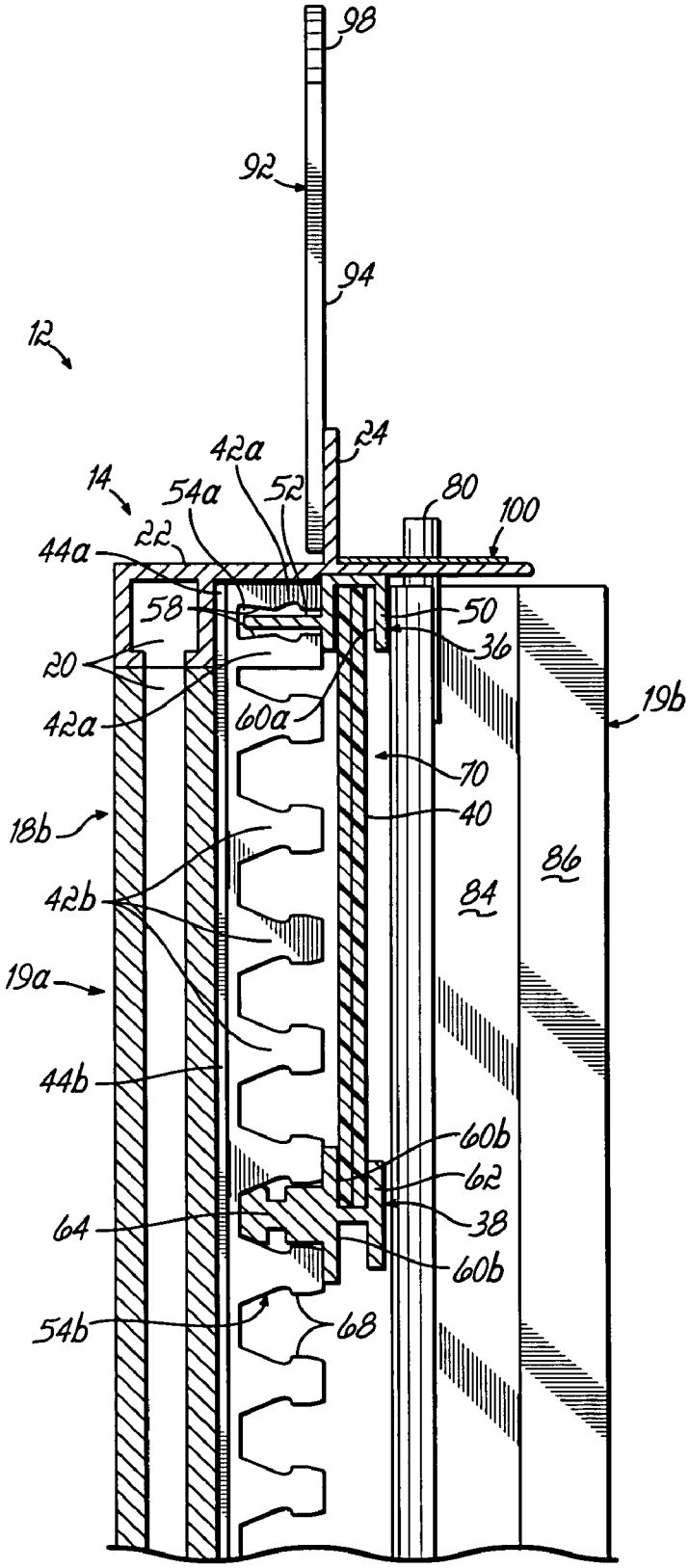
FIG. 9 is a cross sectional view taken along line 9-9 of FIG. 6.
Figure 12:
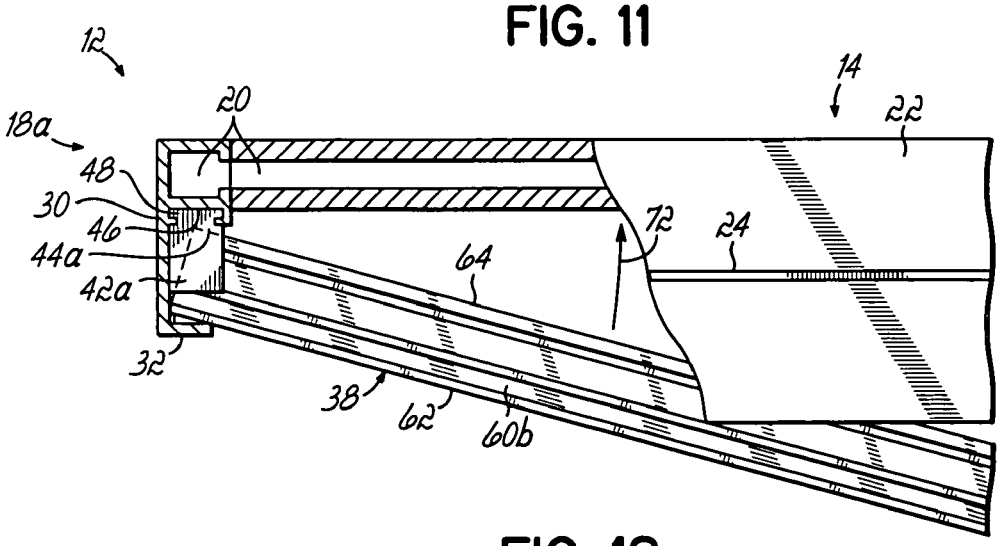
FIG. 12 is an enlarged top plan view, partially broken away, of the circled area in FIG. 11.

In one embodiment, the frame members 14, 16 and 18*a*, and the stationary vertical frame section 19*a* of frame member 18*b*, are made of extruded aluminum and have generally tubular portions 20 (FIGS. 5, 9 and 12). In this way, the frame members 14, 16 and 18*a*, and the stationary vertical frame section of frame member 18*b*, may be readily manufactured with varying horizontal and vertical dimensions to customize the size of the frame 12 for a particular menu board application.

Figure 10:
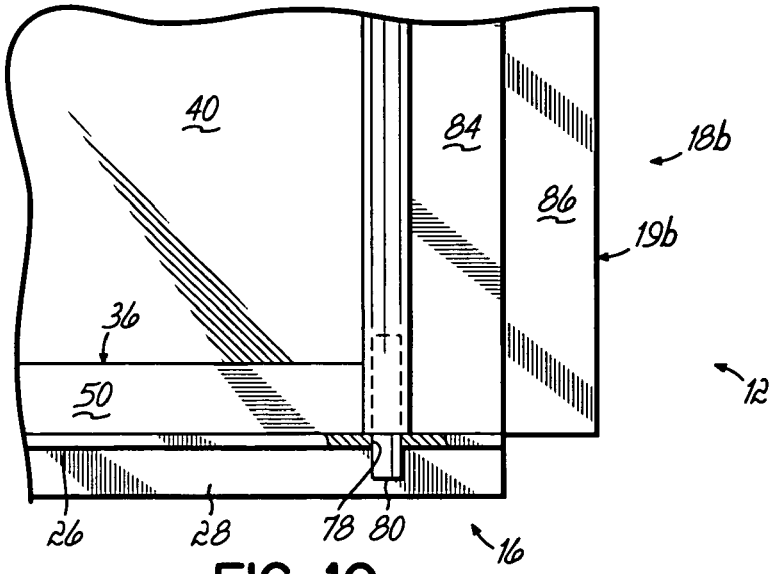
FIG. 10 is an enlarged front elevational view of the lower circled area in FIG. 1.

As shown in FIG. 9, the top frame member 14 has a horizontal top flange portion 22 extending forwardly from the tubular portion 20 of the top frame member 14 and a vertical flange portion 24 extending upwardly from the top flange portion 22. The bottom frame member 16 has a horizontal bottom flange portion 26 extending forwardly from the tubular portion 20 (FIG. 5) of the bottom frame member 16 and a vertical flange portion 28 extending downwardly from the bottom flange portion 26 as shown in FIG. 10. The side frame member 18*a* has a side flange portion 30 (FIG. 12) extending forwardly from the tubular portion 20 (FIG. 12) of the side frame member 18*a* and a front flange or lip portion 32 (FIGS. 1 and 12) extending inwardly from the side flange portion 30 so as to be spaced apart from and overlie the tubular portion 20. The stationary vertical frame section 19*a* of side frame member 18*b* has a side flange portion 34 extending forwardly from the tubular portion 20 of the side frame member 18*b* as shown in FIG. 5. Of course, other configurations of the frame members 14, 16, 18*a* and 18*b* are possible as well without departing from the spirit and scope of the present invention.

With further reference to FIG. 1, menu panel 10 includes parallel top and bottom guide rails 36 and intermediate guide rails 38 supported by the frame 12. The guide rails 36 and 38 are configured to support elongated menu strips (also referred to as "slats") 40 between adjacent pairs of the guide rails 36 and 38 as will be described in greater detail below. Guide rails 36 and 38 are preferably extruded members which are cut to a desired length for a particular width dimension of the frame 12. The menu strips 40 may include customized product description information and interchangeable pricing information for displaying available menu items and pricing information to a customer. The menu strips 40 are back-lit from a light source (not shown) positioned behind the menu panel 10. Details of the construction of the menu strips 40 according to one embodiment of the present invention are fully described in U.S. Pat. Nos. 5,636,463 and 5,901,486, owned by the common assignee, which are hereby incorporated herein by reference in their entirety.

In accordance with the principles of the present invention, the menu panel 10 includes an upper pair of vertically spaced-apart and forwardly extending guide rail locating elements 42*a* (FIG. 9) provided on each of the side frame member 18*a* and the stationary vertical frame section 19*a* of side frame member 18*b* for positioning opposite ends of the top guide rail 36. A similar lower pair of vertically spaced-apart and forwardly extending guide rail locating elements (not shown) are provided on each of the side frame member 18*a* and the stationary vertical frame section 19*a* of side frame member 18*b* for positioning opposite ends of the bottom guide rail 36. A vertical array of spaced-apart and forwardly extending intermediate guide rail locating elements 42*b* are disposed along the respective lengths of side frame member 18*a* and the stationary vertical frame section 19*a* of side frame member 18*b* between the upper and lower pairs 42*a* for positioning opposite ends of the intermediate guide rails 38 at selected vertically spaced positions on the frame 12.

In one embodiment as shown in FIGS. 5, 9 and 12, the upper and lower pairs of guide rail locating elements 42*a* and the intermediate guide rail locating elements 42*b* are preferably vertically spaced along a pair of elongated track members 44*a* (FIG. 12) and 44*b* (FIGS. 5 and 9) which are mounted to the side frame member 18*a* and the stationary vertical frame section 19*a* of side frame member 18*b* prior to final assembly of the frame 12. Each of the side frame member 18*a* and the stationary vertical frame section 19*a* of side frame member 18*b* has an elongated channel 46 which slidably receives a rearwardly extending mounting portion 48 of the track members 44*a* and 44*b* to mount the track members 44*a* and 44*b* to their respective side frame members 18*a* and 18*b*. Alternatively, it is contemplated that the track members 44*a* and 44*b* could be adhered, fastened or otherwise connected in a suitable manner to the respective side frame members 18*a* and 18*b*.

The track members 44*a* and 44*b* are preferably cut from an elongated block of nylon or manufactured of a moldable material, such as plastic or the like, to provide the desired configuration and vertical spacing of the guide rail locating elements 42*a* and 42*b*. In this way, the track members 44*a* and 44*b* can be efficiently manufactured and customized for a particular menu board application, i.e., to provide greater or lesser incremental spacing between adjacent intermediate guide rail locating elements 42*b*. The track members 44*a* and 44*b* are readily interchangeable with track members having different configurations of guide rail locating elements 42*a* and 42*b* so that the menu panel 10 can be modified for a particular application without requiring a change to the frame 12, and in particular to the side frame members 18*a* and 18*b*.

Alternatively, it is contemplated that the track members 44*a* and 44*b* could be milled or otherwise formed from a material such as metal, wood or other suitable material to provide the desired vertical spacing and configuration of the guide rail locating elements 42*a* and 42*b*. It will be appreciated by those of ordinary skill in the art that the track members 44*a* and 44*b* could be dispensed with, and the guide rail locating elements 42*a* and 42*b* could be individually welded, fastened or otherwise connected in a suitable manner directly to the side frame member 18*a* and the vertical frame section 19*a* of side frame member 18*b*. It will further be appreciated that, in another alternative embodiment, the guide rail locating elements 42*a* and 42*b* could be milled or otherwise formed in a suitable manner so as to be integral with the side frame member 18*a* and the vertical frame section 19*a* of side frame member 18*b*.

As shown most clearly in FIG. 9, the intermediate guide rail locating elements 42*b* are disposed at predetermined equally spaced intervals along the length of the side member 18*a* and the vertical frame section 19*a* of side frame member 18*b* to provide adjustable spacing between adjacent pairs of the intermediate guide rails 38 as shown in FIG. 1. In one embodiment, the intermediate guide rail locating elements 42*b* are uniformly vertically spaced at about ⅜" intervals. It will be appreciated by those skilled in the art, however, that greater or lesser spacing between adjacent intermediate guide rail locating elements 42*b* is possible without departing from the spirit and scope of the present invention.

Referring now to FIG. 9, the top guide rail 36 preferably includes an elongated front member 50 having a generally inverted "U-shaped" cross-section and an integral rearwardly extending post member 52. The post member 52 is configured to be loosely positioned at its opposite ends within an upper locating pocket 54*a* formed between the upper pair of guide rail locating elements 42*a* provided on each side frame member 18*a* and 18*b*. The bottom guide rail 36 has a generally "U-shaped" cross-section and is similarly configured to be loosely positioned at its opposite ends within a lower locating pocket (not shown) formed between the lower pair of guide rail support elements (not shown) on each side frame member 18*a* and 18*b*. Each of the front members 50 of the top and bottom guide rails 36 has a longitudinal slot 60*a* extending along its length for purposes to be described in detail below.

Further referring to FIG. 9, each of the intermediate guide rails 38 includes an elongated front member 62 having a generally "H-shaped" cross section and an integral rearwardly extending post member 64. The post members 64 are configured to be loosely positioned within intermediate locating pockets 54*b* formed between adjacent pairs of the intermediate guide rail locating elements 42*b* on each side frame member 18*a* and 18*b*. The front members 62 have upper and lower longitudinal slots 60*b* extending along their lengths which define sleeves 70 between adjacent pairs of the intermediate guide rails 38, and between the top and bottom guide rails 36 and adjacent intermediate guide rails 38 as shown in FIG. 9.

Figure 6:
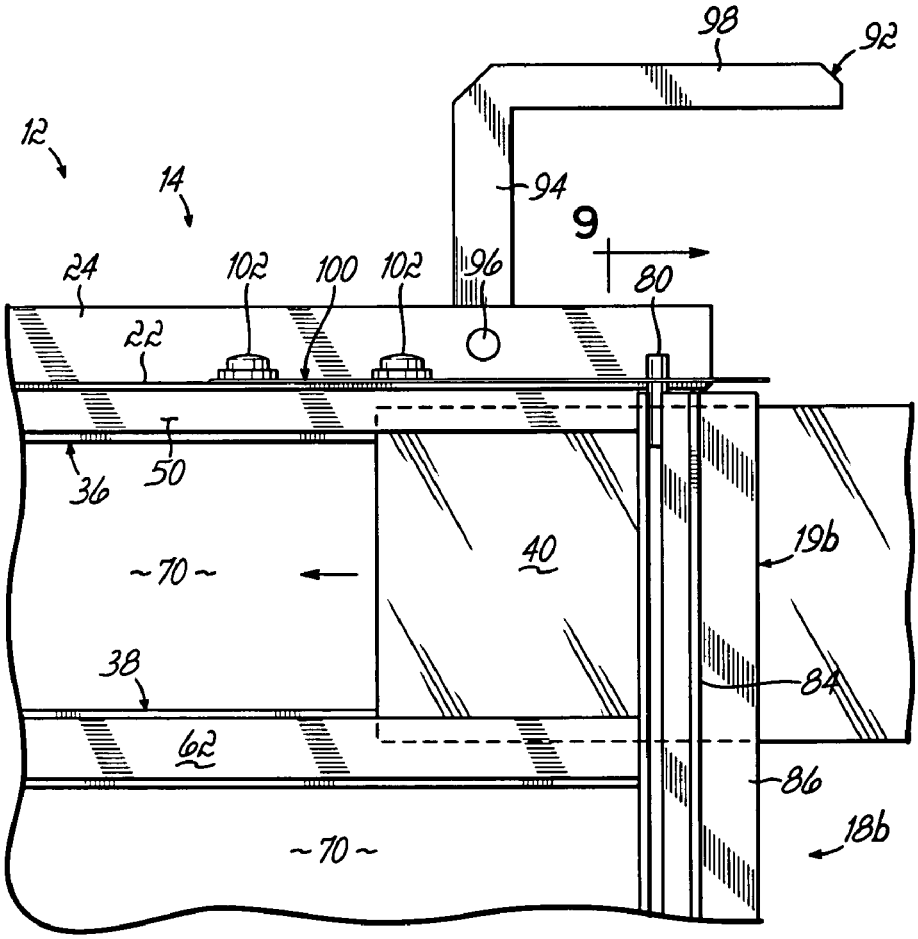
FIG. 6 is an enlarged front elevational view similar to FIG. 4, showing partial insertion of a menu strip between an adjacent pair of guide rails.

Preferably, the sleeves 70 are disposed forwardly of the vertical frame section 19*a* of side frame member 18*b* so that the menu strips 40 are slidably received within the sleeves 70 from one end of the guide rails 36 and 38 adjacent the vertical frame section 19*a* of side frame member 18*b* as shown in FIGS. 5 and 6. It will be appreciated by those skilled in the art that the front members 62 could be modified to a "T", "double-T", or "double-H" cross-section, for example, without departing from the spirit and scope of the present invention.

As shown in FIGS. 1, 9, 11 and 12, the opposite ends of the intermediate guide rails 38 are selectively positioned in the intermediate locating pockets 54*b* to provide adjustable spacing between adjacent pairs of the intermediate guide rails 38, and to provide adjustable spacing between the top and bottom guide rails 36 and adjacent intermediate guide rails 38. In this way, menu strips 40, or photographs (also referred to as "transparencies" or "translites") (not shown), of varying heights can be accommodated in the sleeves 70. It will be appreciated that the menu strips 40 will have a height that is substantially a multiple of the predetermined equally spaced intervals of the intermediate guide rail locating elements 42*b*.

Figure 11:
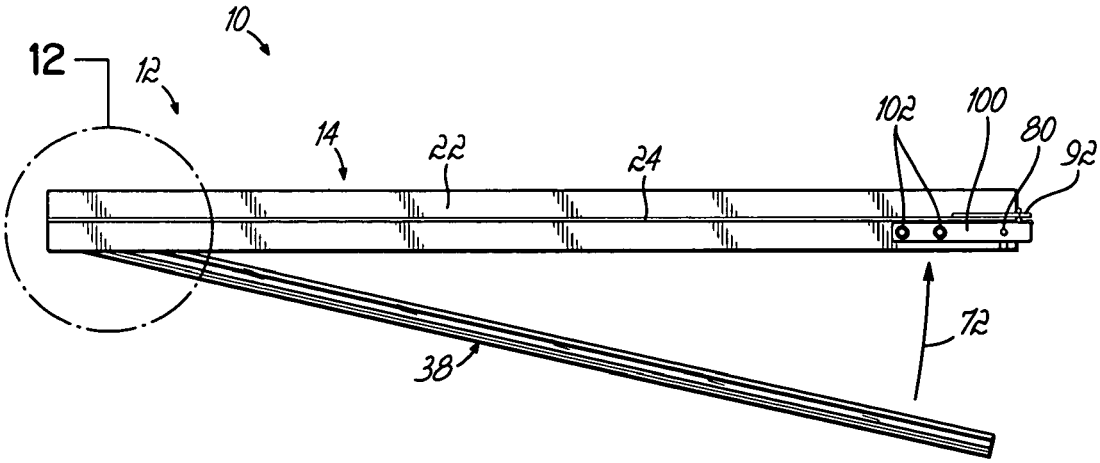
FIG. 11 is a view similar to FIG. 2, showing insertion of a guide rail into the adjustable menu panel of FIG. 1.

As shown in FIGS. 11 and 12, the leftmost ends of the intermediate guide rails 38 are loosely positioned within the intermediate locating pockets 54*b* provided along the length of the side frame member 18*a* by inserting the leftmost ends of the intermediate guide rails 38 laterally in a leftward direction generally parallel to a plane defined by the menu board 10. The front flange or lip portion 32 of the side frame member 18*a* overlies the respective leftmost ends of the intermediate guide rails 38 to partially retain the intermediate guide rails 38 within the intermediate locating pockets 54*b* provided along the length of the side frame member 18*a*. Preferably, there is no positive locking engagement or significant frictional engagement between the respective leftmost ends of the intermediate guide rails 38 and the intermediate locating pockets 54*b* provided along the length of the side frame member 18*a* such that the intermediate guide rails may freely move within the intermediate locating pockets 54*b*.

With the removable and rotatable vertical frame section 19*b* disassembled and removed from the top and bottom frame members 14, 16, the respective rightmost opposite ends of the intermediate guide rails 38 are then generally pivoted toward the stationary vertical frame section 19*a* of side frame member 18*b*, as represented by arrow 72 in FIGS. 11 and 12, so as to be loosely received within the intermediate locating pockets 54*b* provided along the length of the stationary frame section 19*a* of side frame member 18*b*. Again, there is preferably no positive locking engagement or significant frictional engagement between the respective rightmost ends of the intermediate guide rails 38 and the intermediate locating pockets 54*b* provided along the length of the stationary frame section 19*a* of side frame member 18*b* such that the intermediate guide rails 38 may freely move within the intermediate locating pockets 54*b*. The top and bottom guide rails 36 are similarly positioned within the upper and lower locating pockets 54*a*.

Figure 7:
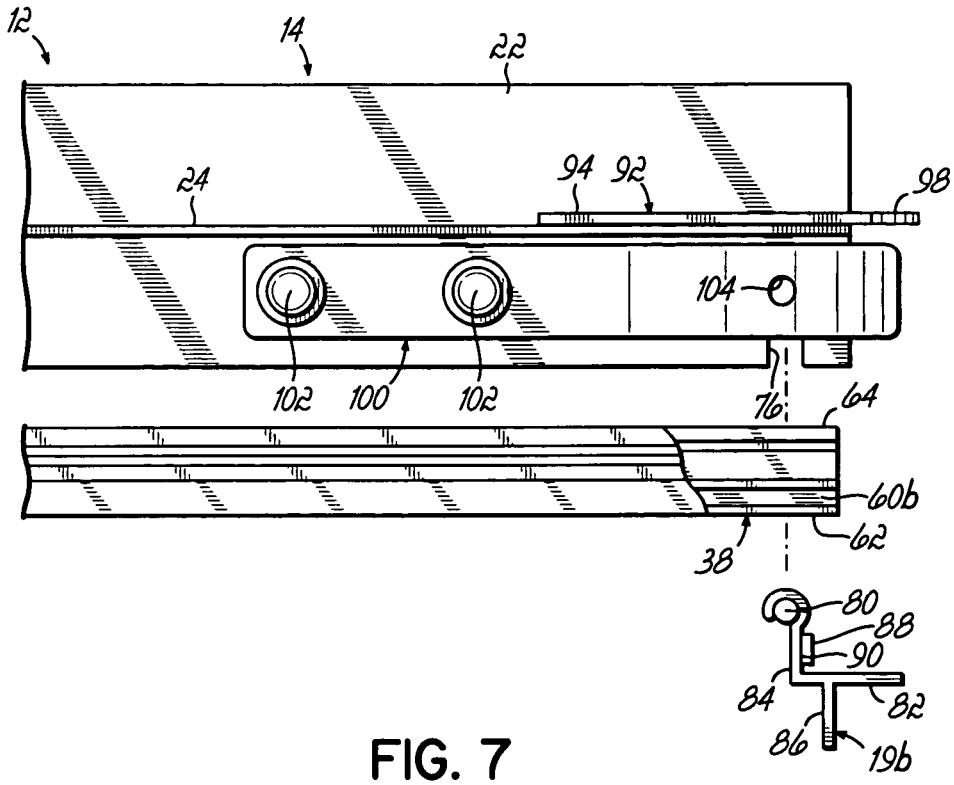
FIG. 7 is an enlarged top plan view similar to FIG. 3, showing assembly of the adjustable menu panel of FIG. 1.

In accordance with another aspect of the present invention, the removable and rotatable vertical frame section 19*b* is selectively engageable and disengageable with the top and bottom frame members 14, 16 adjacent the stationary vertical frame section 19*a* of side frame member 18*b*. In its engaged position as shown in FIGS. 1, 3-6 and 8-10, the removable and rotatable vertical frame section 19*b* overlies respective rightmost ends of the guide rails 36 and 38 positioned within the respective locating pockets 54*a* and 54*b* provided along the length of the stationary vertical frame section 19*a* to retain, in conjunction with the front flange or lip portion 32 of side frame member 18*a*, the guide rails 36, 38 within the locating pockets 54*a*, 54*b*. In the disengaged position of the rotatable and removable vertical frame section 19*b* as shown in FIG. 7, the guide rails 36, 38 may be removed from the locating pockets 54*a*, 54*b* provided along the respective lengths of the side frame member 18*a* and stationary vertical frame section 19*a* of side frame member 18*b*. Absent disassembly and removal of the removable and rotatable vertical frame section 19*b*, the guide rails 36, 38 cannot be inserted into or removed from the menu panel 10.

In one embodiment, the top frame member 14 has a slot 76 (FIGS. 3 and 7) formed in the horizontal top flange portion 22 and the bottom frame member 16 has an aperture 78 formed in the horizontal bottom flange portion 26 which is vertically aligned with the slot 76. The removable and rotatable vertical frame section 19*b* of side frame member 18*b* has a pin 80 extending outwardly from each end of the vertical frame section 19*b* so that the pins 80 are engageable with the slot 76 and aperture 78 when the vertical frame section 19*b* is selectively engaged with the top and bottom frame members 14, 16 as shown in FIGS. 1, 3-6 and 8-10.

Figure 3:
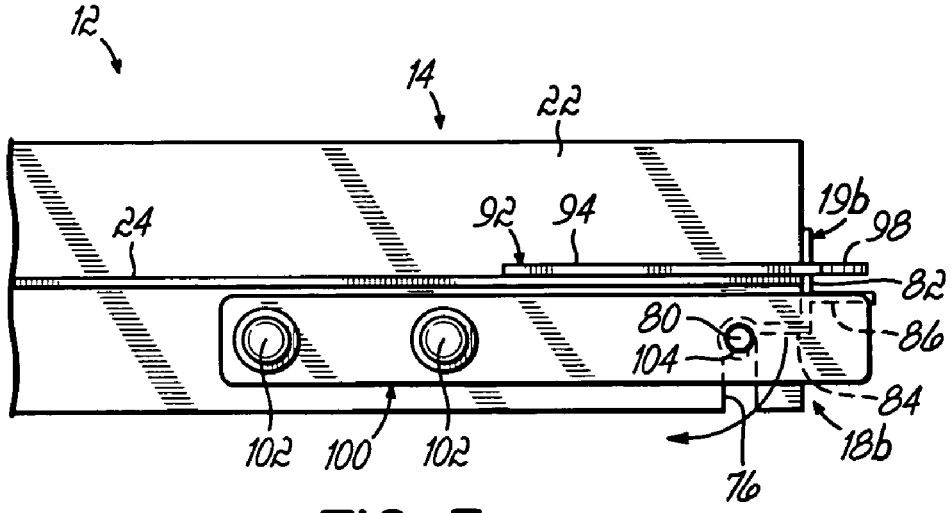
FIG. 3 is an enlarged top plan view of the circled area in FIG. 2.
Figure 4:
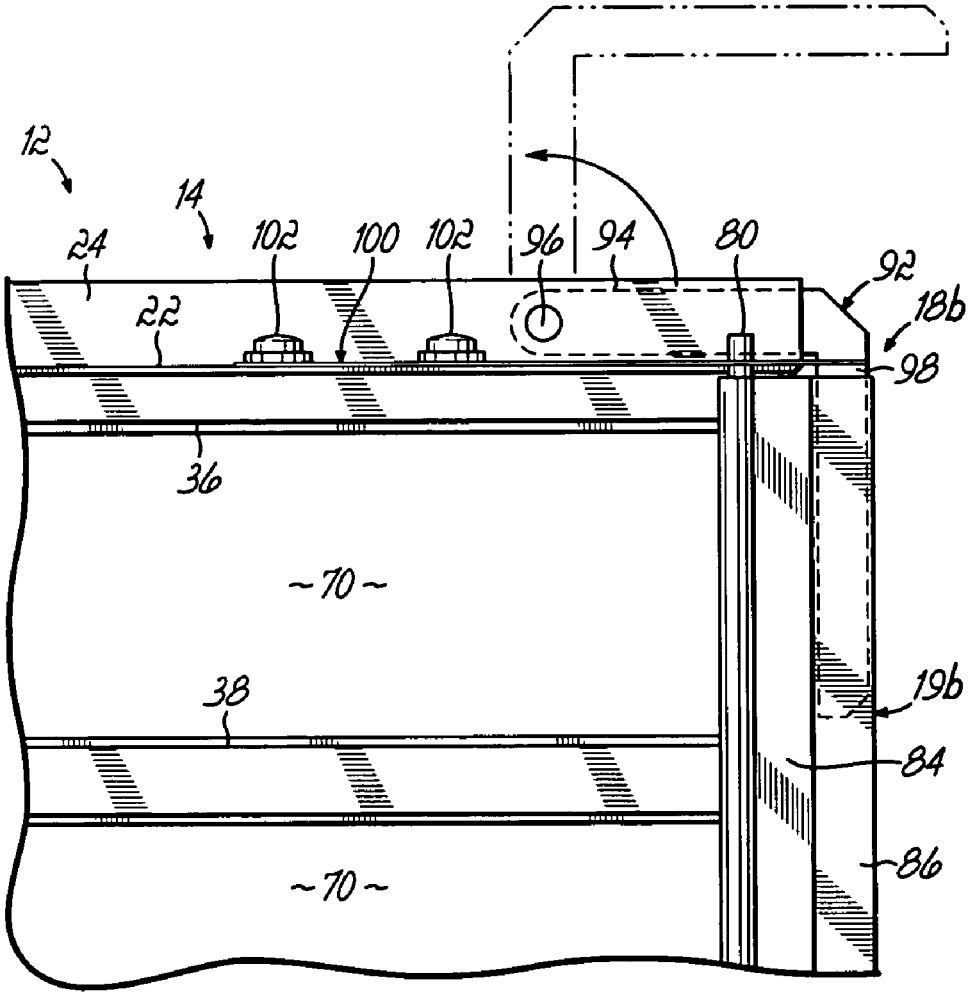
FIG. 4 is an enlarged front elevational view of the upper circled area in FIG. 1.

The pins 80 form pivot connections with the slot 76 and aperture 78 so that the removable and rotatable vertical frame section 19*b* is pivotally connected to the top and bottom frame members 14, 16. The vertical frame section 19*b* has a side flange portion 82, a front flange portion 84 extending inwardly from the side flange portion 82, and a flange portion 86 extending outwardly from the side flange portion 82. The vertical frame section 19*b* is manually pivotal between an open position as shown in FIGS. 5 and 6, which permits insertion of the menu strips 40 within the sleeves 70, and a closed position as shown in FIGS. 1, 3 and 4 to retain the menu strips 40 within the sleeves 70. An elongated compressible strip of material 88 (FIGS. 5 and 7) is adhered to an inner surface 90 of the front flange portion 84 of the vertical frame section 19*b*. The compressible material 88 engages the respective ends of the intermediate guide rails 38 positioned within the intermediate locating pockets 54*b* provided along the length of the stationary vertical frame section 19*a* of side frame member 18*b* when the removable and rotatable vertical frame section 19*b* is pivoted to the closed position. The side flange portion 82 of the vertical frame section 19*b* prevents the menu strips 40 from sliding out of the sleeves 70 when the vertical frame section 19*b* is pivoted to the closed position.

Figure 8:
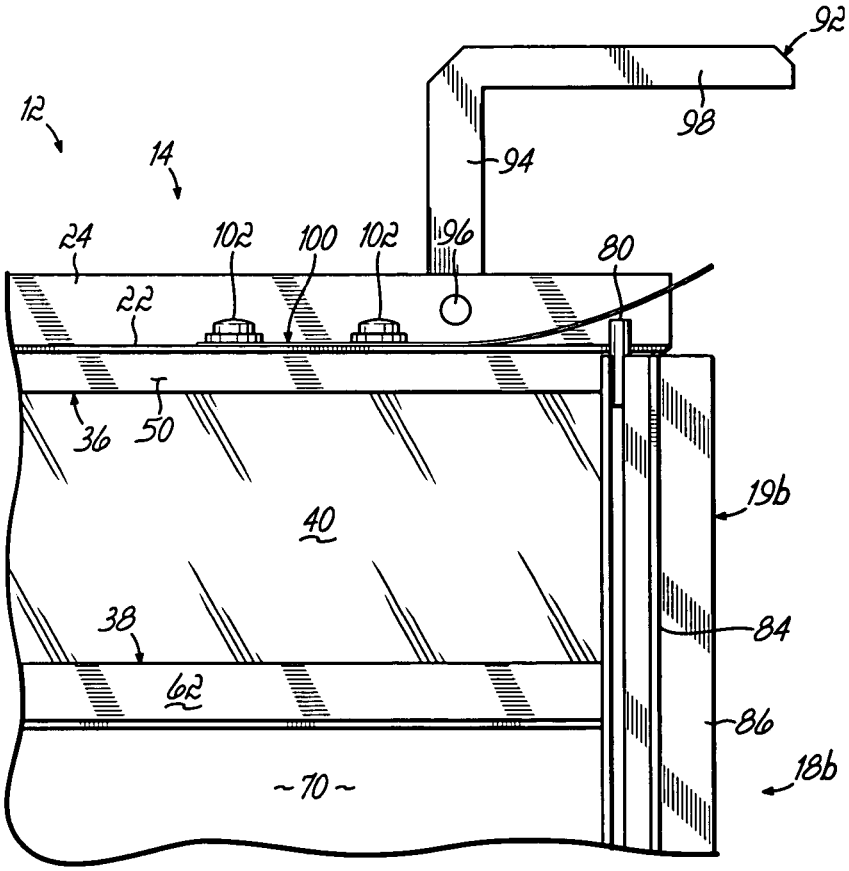
FIG. 8 is an enlarged front elevational view similar to FIG. 6, showing assembly of the adjustable menu panel of FIG. 1.

In one embodiment, a generally "L-shaped" locking member 92 is pivotally connected to the frame 12 so as to be manually pivotal between locked and unlocked positions. The locking member 92 has one end of a leg 94 pivotally connected to the vertical flange portion 24 of the top frame member 14 through a pin 96 (FIGS. 4, 6 and 8). In the locked position as shown in FIGS. 1-4, the locking member 92 is pivoted downwardly so that a leg 98 of the locking member 92 engages the side flange 82 of the removable and rotatable vertical frame section 19*b* to lock the vertical frame section 19*b* in the closed position.

In the locked position, the leg 98 of the locking member 92 is positioned rearwardly of the flange portion 86 extending outwardly from the side flange portion 82 of the removable and rotatable vertical frame section 19*b*. When the locking member 92 is pivoted upwardly to the unlocked position as shown in FIGS. 6, 8 and 9, the leg 98 of the locking member 92 is disengaged from the vertical frame section 19*b* so that the vertical frame section 19*b* is permitted to pivot to the open position.

In accordance with another aspect of the present invention, a locking member 100, such as a flexible leaf spring, has one end connected to the horizontal top flange portion 22 of the top frame member 14 through a pair of rivets or screws 102 as shown in FIGS. 1-8. A free end of the locking member 100 has an aperture 104 (FIGS. 3 and 7) formed therein which is vertically aligned with the slot 76. The free end of the locking member 100 is manually flexed upwardly as shown in FIG. 8 to permit the vertical frame section 19*b* to be selectively engaged with the slot 76 and the aperture 78. The free end of the locking member 100 is then released so that it returns to its unflexed position and the aperture 104 engages the pin 80 extending upwardly from the vertical frame section 19*b* to retain the vertical frame section 19*b* in its engaged position with the top and bottom frame members 14, 16. The vertical frame section 19*b* is selectively disengaged from the top and bottom frame members 14, 16 by manually flexing the free end of the locking member 100 upwardly to disengage the aperture 104 and the pin 80. This permits the vertical frame section 19*b* to be disengaged from the slot 76 and the aperture 76.

In use of the menu panel 10 of the present invention, the frame members 14, 16 and 18*a*, and the stationary vertical frame section 19*a* of frame member 18*b*, are extruded and cut to desired lengths for a specific menu board application. The top and bottom guide rails 36 and intermediate guide rails 38 are also extruded and cut to a desired length for the particular size of the frame 12.

The pair of track members 44*a* and 44*b* are manufactured to have the desired configuration and spacing of the guide rail locating elements 42*a* and 42*b*. The track members 44*a* and 44*b* are then mounted to the side frame member 18*a* and the stationary vertical frame section 19*a* of side frame member 18*b* by sliding the rearwardly extending mounting portions 48 of the track members 44*a* and 44*b* within the elongated channels 46. The side frame member 18*a* and the stationary vertical frame section 19*a* of side frame member 18*b* are connected at their opposite ends to the respective opposite ends of the top and bottom frame members 14, 16.

To locate the top and bottom guide rails 36 and the intermediate guide rails 38 within the locating pockets 54*a* and 54*b*, respectively, the removable and rotatable vertical frame section 19*b* is disassembled and removed from the top and bottom frame members 14, 16. The top and bottom guide rails 36 are then loosely positioned within the upper and lower locating pockets 54*a*. The intermediate guide rails 38 are selectively loosely positioned within the intermediate locating pockets 54*b* to provide the desired spacing between adjacent pairs of the intermediate guide rails 38, and to provide the desired spacing between the top and bottom guide rails 36 and adjacent intermediate guide rails 38.

The front flange portion 32 of the side frame member 18*a* prevents insertion of the guide rails 36, 38 within the locating pockets 54*a*, 54*b* in an insertion direction perpendicular to a plane defined by the frame 12. Rather, the respective leftmost ends of the guide rails 36, 38 are inserted laterally in a leftward direction and generally parallel to a plane defined by the menu panel 10 so as to be positioned within the respective locating pockets 54*a*, 54*b* provided along the length of the side frame member 18*a* and rearwardly of the front flange portion 32 as shown in FIG. 12. The respective opposite rightmost ends of the guide rails 36, 38 are then generally pivoted toward the stationary vertical frame section 19*a* of side frame member 18*b*, as represented by arrow 72 in FIGS. 11 and 12, so as to be loosely positioned within the respective locating pockets 54*a*, 54*b* provided along the length of the stationary vertical frame section 19*a*.

The removable and rotatable vertical frame section 19*b* of side frame member 18*b* is then selectively engaged with the top and bottom frame members 14, 16 by engaging the pins 80 with the slot 76 and the aperture 78. The aperture 104 of the locking member 100 is engaged with the upper pin 80 to lock the vertical frame section 19*b* in its engaged position with the top and bottom frame members 14, 16. The vertical frame section 19*b*, in conjunction with the front flange or lip portion 32 of side frame member 18*a*, retains the guide rails 36, 38 within the locating pockets 54*a*, 54*b*.

The removable and rotatable vertical frame section 19*b* of side frame member 18*b* is pivoted to its open position to permit the menu strips 40 to be slidably received in the sleeves 70 formed between adjacent pairs of the guide rails 36 and 38. The vertical frame section 19*b* is then pivoted to its closed position to retain the menu strips 40 within the sleeves 70 and the locking member 92 is pivoted downwardly to lock the vertical frame section 19*b* in its closed position.

When the menu strips 40 need to be modified or replaced, the vertical frame section 19*b* is unlocked by pivoting the locking member 92 upwardly. The vertical frame section 19*b* is then free to pivot to its open position so the menu strips 40 can be readily removed and inserted within the sleeves 70.

When the height of one or more menu strips 40 needs to be changed, the rotatable and removable vertical frame section 19*b* of side frame member 18*b* is disengaged from the top and bottom frame members 14, 16 and removed, and the intermediate guide rails 38 are then selectively repositioned within the intermediate locating pockets 54*b* to provide new sleeves 70 having the proper height to accommodate the height changes in the menu strips 40. The vertical frame section 19*b* is then re-engaged with the top and bottom frame members 14, 16 and locked in its engaged position by the locking member 100. The vertical frame section 19*b* is then pivoted between the open and closed positions as described in detail above to receive and retain the menu strips 40 within the sleeves 70.

Figure 13:
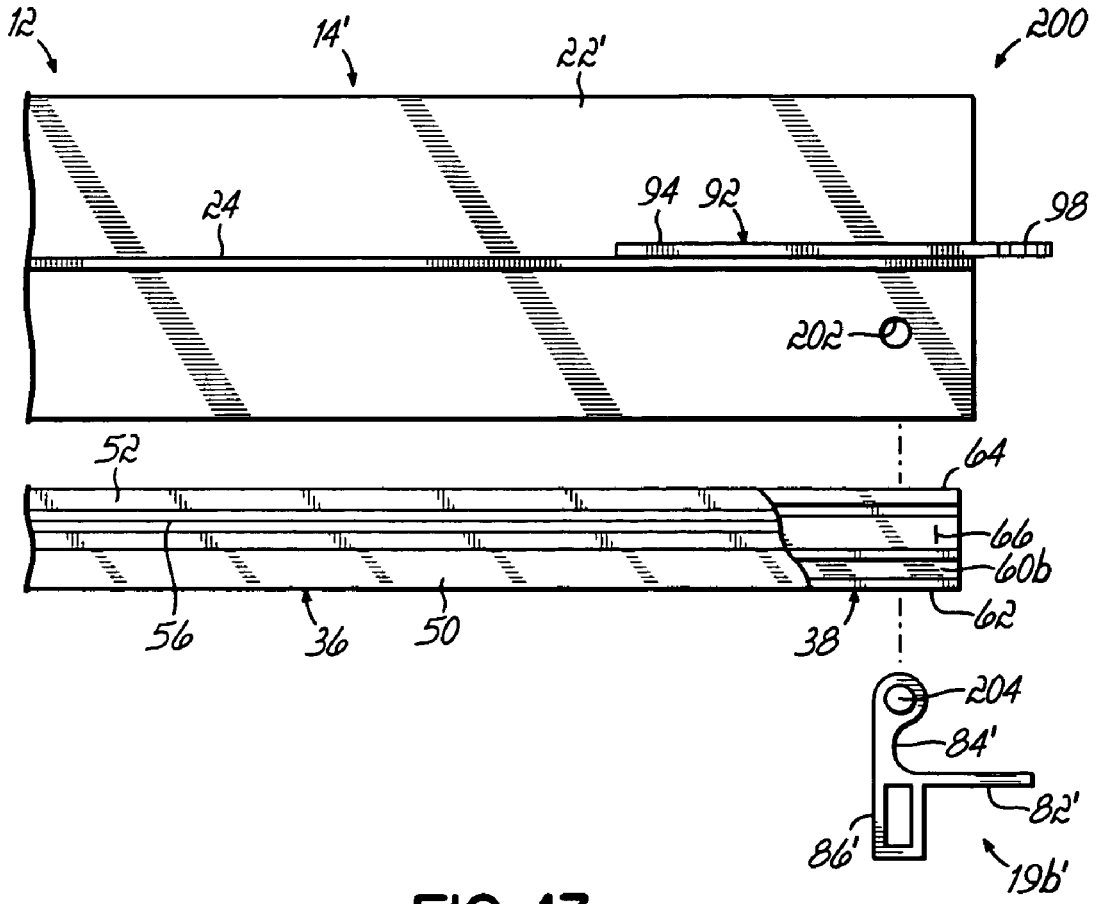
FIG. 13 is an enlarged top plan view showing assembly of an adjustable menu panel according to a second embodiment of the present invention.
Figure 14:
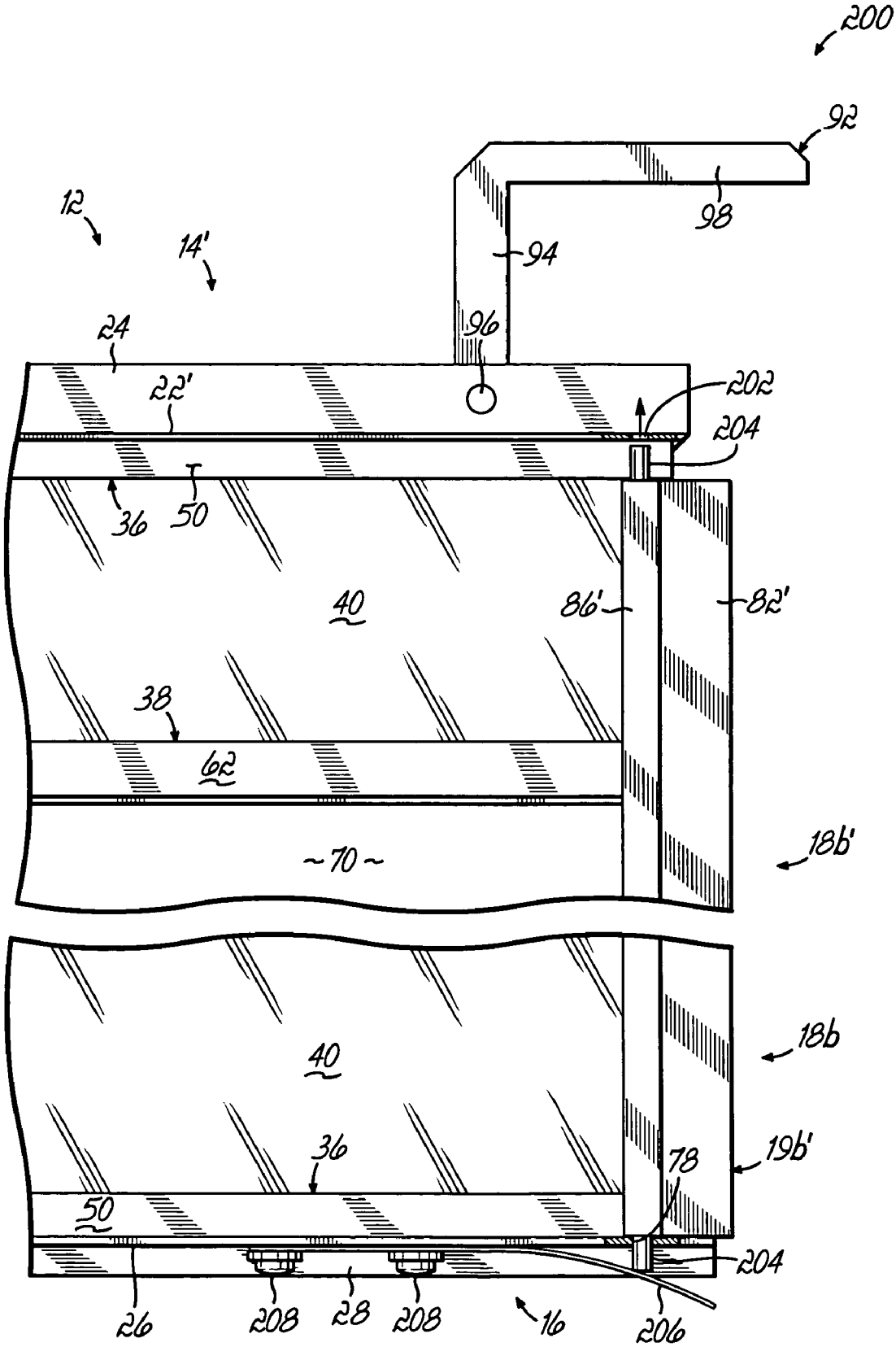
FIGS. 14 and 15 are enlarged front elevational views showing assembly of the adjustable menu panel of FIG. 13.
Figure 15:
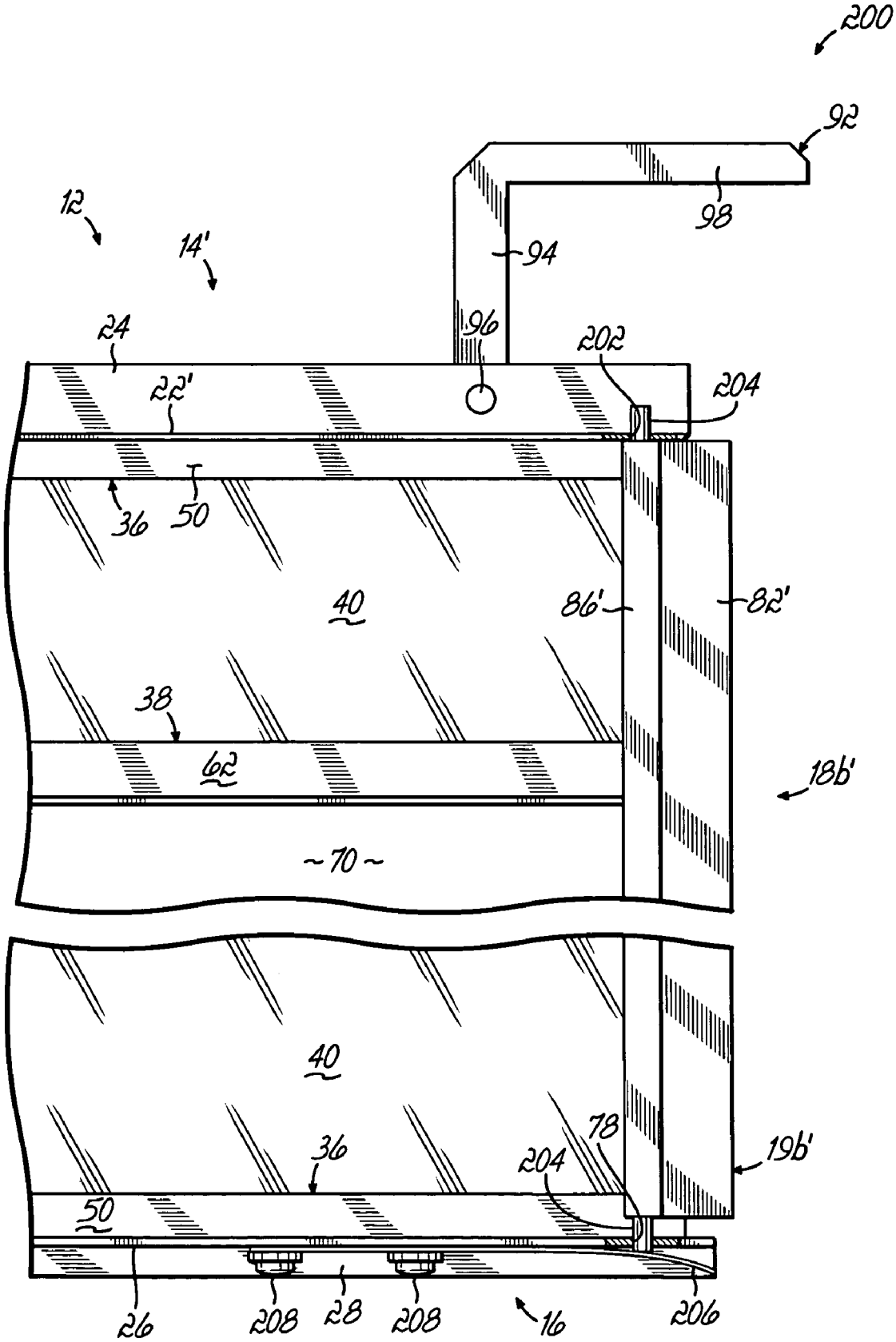

Referring now to FIGS. 13-15, an adjustable menu panel 200 according to an alternative embodiment of the present invention is shown, where like numerals represent like parts to the adjustable menu panel 10 of FIGS. 1-12. In this embodiment, a removable and rotatable vertical frame section 19*b*' is pivotally connected to the top and bottom frame members, 14', 16 so as to be disposed adjacent to the stationary vertical frame section 19*a*. The vertical frame section 19*b*' has a side flange portion 82', a front flange portion 84' extending inwardly from the side flange portion 82', and a flange portion 86' extending outwardly from the side flange portion 82'. The vertical frame section 19*b*' is manually pivotal between an open position as shown in FIGS. 14 and 15, which permits insertion of the menu strips 40 within the sleeves 70, and a closed position (not shown) to retain the menu strips within the sleeves 70.

Further referring to FIGS. 13-15, the top frame member 14' has an aperture 202 formed in the horizontal top flange portion 22' and the bottom frame member 16 has the aperture 78 (FIG. 10) formed in the horizontal bottom flange portion 26 which is vertically aligned with the aperture 202. The removable and rotatable vertical frame section 19*b* ' of side frame member 18*b*' has a pin 204 extending outwardly from each end of the vertical frame section 19*b*' so that the pins 204 are engageable with the respective apertures 78 and 202 when the vertical frame section 19*b*' is selectively engaged with the top and bottom frame members 14', 16 as shown in FIGS. 14 and 15. The pins 204 form pivot connections with the respective apertures 78 and 202 so that the removable and rotatable vertical frame section 19*b*' is pivotally connected to the top and bottom frame members 14', 16.

As shown in FIGS. 14 and 15, a flexible leaf spring 206 has one end connected to the horizontal bottom flange portion 26 of the bottom frame member 14 through a pair of rivets or screws 208. A free end of the leaf spring 206 overlies the aperture 78 formed in the horizontal bottom flange portion 26 of the bottom frame member 16.

The removable and rotatable vertical frame section 19*b*' is engaged with the top and bottom frame members 14', 16 by first inserting the lower pin 204 into the aperture 78 formed in the horizontal bottom flange portion 26 of the bottom frame member 16 as shown in FIG. 14. The vertical frame section 19*b*' is pushed downwardly to flex the leaf spring 206 as shown in FIG. 14 so that the upper pin 204 is free to be aligned with the aperture 202 formed in the horizontal top flange portion 22'. Thereafter, the downward force applied to the vertical frame section 19*b*' is removed so that the leaf spring 206 flexes upwardly to engage the upper pin 204 in the aperture 202 formed in the horizontal top flange portion 22' of the top frame member as shown in FIG. 15.

In its engaged position as shown in FIG. 15, the removable and rotatable vertical frame section 19*b*' overlies respective right most ends of the guide rails 36, 38 positioned within the respective locating pockets 54*a* and 54*b* provided along the length of the stationary vertical frame section 19*a* to retain, in conjunction with the front flange or lip portion 32 of side frame member 18*a*, the guide rails 36, 38 within the locating pockets 54*a*, 54*b*. In the disengaged position of the rotatable and removable vertical frame section 19*b* as shown in FIG. 13, the guide rails 36, 38 may be removed from the locating pockets 54*a*, 54*b* provided along the respective lengths of the side frame member 18*a* and the stationary vertical frame section 19*a* of side frame member 18*b*'. Absent disassembly and removal of the removable and rotatable vertical frame section 19*b*', the guide rails 36, 38 cannot be inserted into or removed from the menu panel 200.

Figure 16:
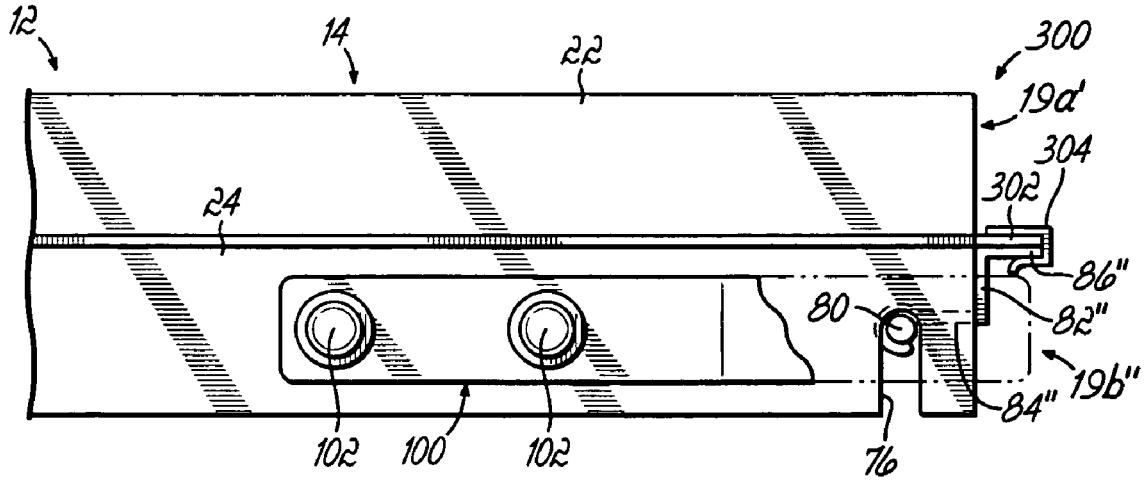
FIG. 16 is an enlarged top plan view of an adjustable menu panel according to a third embodiment of the present invention.

Referring now to FIG. 16, an adjustable menu panel 300 in accordance with another aspect of the present invention is shown. In this embodiment, a removable and rotatable vertical frame section 19*b*" is pivotally connected to the top and bottom frame members 14, 16 so as to be disposed adjacent to a stationary vertical frame section 19*a*'. The vertical frame section 19*b*' has a side flange portion 82", a front flange portion 84" extending inwardly from the side flange portion 82", a flange portion 86" extending outwardly from the side flange portion 82". The vertical frame section 19*b*" is manually pivotal between an open position (not shown) which permits insertion of the menu strips 40 within the sleeves 70, and a closed position as shown in FIG. 16 to retain the menu strips within the sleeves 70.

Further referring to FIG. 16, a flange portion 302 is provided to extend outwardly from the stationary vertical frame section 19*a*". The adjustable menu panel 300 incorporates one or more locking clips 304 which are utilized to lock the removable and rotatable vertical frame section 19*b*" in the closed position as shown in FIG. 16 to retain the menu strips within the sleeves 70. The locking clips engage the flange portion 86" extending outwardly from the side flange portion 82" of the vertical frame section 19*b*" and the flange portion 302 extending outwardly from the stationary vertical frame section 19*a*'.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicants' invention.

Having described the invention, what is claimed is:

1. An adjustable menu panel, comprising:

an assembled frame having a top frame member, a bottom frame member and first and second vertical side frame members extending in spaced relationship between said top and bottom frame members, one of said first and second vertical side frame members having a stationary vertical frame section and a removable and rotatable vertical frame section disposed adjacent said stationary vertical frame section;

a plurality of guide rail locating elements disposed vertically along each of said vertical side frame members, each adjacent pair of said guide rail locating elements defining a locating pocket therebetween;

a plurality of generally parallel guide rails selectively positionable in said locating pockets at opposite ends of said guide rails, said guide rails thereby being selectively positionable in said locating pockets at regularly and variably spaced locations vertically along said first and second vertical side frame members to provide the same and different spacing between adjacent pairs of said guide rails;

a plurality of elongated menu strips having descriptive indicia thereon, each of said menu strips being disposed between and supported by a different one of said adjacent pairs of guide rails; and said removable and rotatable vertical frame section being selectively engageable and selectively disengageable with said top and bottom frame members such that said removable and rotatable vertical frame section, in an engaged position with said top and bottom frame members, overlies respective ends of said guide rails positioned in said locating pockets along said one of said first and second vertical side frame members so as to retain said guide rails in said locating pockets and, in a disengaged position with said top and bottom frame members, permits removal of said guide rails from said locating pockets.

2. The adjustable menu panel of claim 1 wherein said removable and rotatable vertical frame section is pivotally connected to said top and bottom frame members.

3. The adjustable menu panel of claim 2 wherein said removable and rotatable vertical frame section is pivotal between open and closed positions, said removable and rotatable vertical frame section, in the open position, permitting insertion of said menu strips between adjacent pairs of said guide rails and, in the closed position, retaining said menu strips between said adjacent pairs of guide rails.

4. The adjustable menu panel of claim 3 further composing a locking clip selectively engageable and disengageable with said frame and said removable and rotatable vertical frame section, said locking clip, in an engaged position, locking said removable and rotatable vertical frame section in the closed position and, in a disengaged position, permitting pivotal movement of said removable and rotatable vertical frame section to the open position.

5. The adjustable menu panel of claim 3 further comprising a first locking member pivotally connected to said frame and selectively pivotable between locked and unlocked positions, said first locking member, in the locked position, engaging said removable and rotatable vertical frame section to lock said removable and rotatable vertical frame section in the closed position and, in the unlocked position, permitting pivotal movement of said removable and rotatable vertical frame section to the open position.

6. The adjustable menu panel of claim 1 further comprising:

an aperture formed in one of said top and bottom frame members;

a slot formed in the other of said top and bottom frame members; and a pin extending outwardly from each end of said removable and rotatable vertical frame section, each of said pins engaging one of said aperture and said slot when said removable and rotatable vertical frame section is selectively engaged with said top and bottom frame members in the engaged position.

7. The adjustable menu panel of claim 6 further comprising:

a second locking member connected to said frame and selectively engageable with one of said pins when said removable and rotatable vertical frame section is selectively engaged with said top and bottom frame members so as to retain said removable and rotatable vertical frame section in the engaged position.

8. The adjustable menu panel of claim 7 wherein said second locking member comprises a flexible leaf spring.

9. The adjustable menu panel of claim 1 further comprising: a first aperture formed in said top frame member;

a second aperture formed in said bottom frame member;

a pin extending outwardly from each end of said removable and rotatable vertical frame section, each of said pins engaging one of said first and second apertures when said removable and rotatable vertical frame section is engaged with said top and bottom frame members in the engaged position.

10. The adjustable menu panel of claim 1 wherein said guide rails are slotted longitudinally to slidably receive opposite longitudinal edges of one of said menu strips between an adjacent pair of said guide rails.

11. The adjustable menu panel of claim 1 wherein at least one of said menu strips has a height measured in a direction parallel to the length of said side members that is different than the height of said at least one other menu strip.

12. An adjustable menu panel, comprising:

an assembled frame having a top frame member, a bottom frame member and first and second vertical side frame members extending in spaced relationship between said top and bottom frame members, one of said first and second vertical side frame members having a stationary vertical frame section and a removable and rotatable vertical frame section disposed adjacent said stationaly vertical frame section;

a plurality of guide rail locating elements disposed vertically along each of said vertical side frame members, each adjacent pair of said guide rail locating elements defining a locating pocket therebetween;

a plurality of generally parallel guide rails selectively positionable in said locating pockets at opposite ends of said guide rails, said guide rails thereby being selectively positionable in said locating pockets at regularly and variably spaced locations vertically along said first and second vertical side frame members to provide the same and different spacing between adjacent pairs of said guide rails, said guide rails being configured to receive and retain a menu strip having descriptive indicia thereon between an adjacent pair of said guide rails; and said removable and rotatable vertical frame section being selectively engageable and selectively disengageable with said top and bottom frame members such that said removable and rotatable vertical frame section, in an engaged position with said top and bottom frame members, overlies respective ends of said guide rails positioned in said locating pockets along said one of said first and second vertical side frame members so as to retain said guide rails in said locating pockets and, in a disengaged position with said top and bottom frame members, permits removal of said guide rails from said locating pockets.

13. The adjustable menu panel of claim 12 wherein said removable and rotatable vertical frame section is pivotally connected to said top and bottom frame members.

14. The adjustable menu panel of claim 13 wherein said removable and rotatable vertical frame section is pivotal between open and closed positions, said removable and rotatable vertical frame section, in the open position, permitting insertion of the menu strips between adjacent pairs of said guide rails and, in the closed position, retaining the menu strips between said adjacent pairs of guide rails.

15. The adjustable menu panel of claim 14 further composing a locking clip selectively engageable and disengageable with said frame and said removable and rotatable vertical frame section, said locking clip, in an engaged position, locking said removable and rotatable vertical frame section in the closed position and, in a disengaged position, permitting pivotal movement of said removable and rotatable vertical frame section to the open position.

16. The adjustable menu panel of claim 14 further comprising a first locking member pivotally connected to said frame and selectively pivotable between locked and unlocked positions, said first locking member, in the locked position, engaging said removable and rotatable vertical frame section to lock said removable and rotatable vertical frame section in the closed position and, in the unlocked position, permitting pivotal movement of said removable and rotatable vertical frame section to the open position.

17. The adjustable menu panel of claim 12 further comprising:

an aperture formed in one of said top and bottom frame members;

a slot formed in the other of said top and bottom frame members; and a pin extending outwardly from each end of said removable and rotatable vertical frame section, each of said pins engaging one of said aperture and said slot when said removable and rotatable vertical frame section is selectively engaged with said top and bottom frame members in the engaged position.

18. The adjustable menu panel of claim 17 further comprising:

a second locking member connected to said frame and selectively engageable with one of said pins when said removable and rotatable vertical frame section is selectively engaged with said top and bottom frame members so as to retain said removable and rotatable vertical frame section in the engaged position.

19. The adjustable menu panel of claim 18 wherein said second locking member comprises a flexible leaf spring.

20. The adjustable menu panel of claim 12 further comprising:

a first aperture formed in said top frame member;

a second aperture formed in said bottom frame member;

a pin extending outwardly from each end of said removable and rotatable vertical frame section, each of said pins engaging one of said first and second apertures when said removable and rotatable vertical frame section is engaged with said top and bottom frame members in the engaged position.

21. The adjustable menu panel of claim 12 wherein said guide rails are slotted longitudinally to slidably receive opposite longitudinal edges of one of the menu strips between an adjacent pair of said guide rails.

22. An adjustable menu panel, comprising:

an assembled frame having a top frame member, a bottom frame member and first and second vertical side frame members extending in spaced relationship between said top and bottom frame members, one of said first and second vertical side frame members having a stationary vertical frame section and a removable and rotatable vertical frame section disposed adjacent said stationary vertical frame section;

a pair of elongated track members, each of said track members being mounted on a respective one of said first and second vertical side frame members and having a plurality of guide rail locating elements disposed vertically along the length of each track member, each adjacent pair of said guide rail locating elements defining a locating pocket therebetween;

a plurality of generally parallel guide rails selectively positionable in said locating pockets at opposite ends of said guide rails, said guide rails thereby being selectively positionable in said locating pockets at regularly and variably spaced locations vertically along said first and second vertical side frame members to provide the same and different spacing between adjacent pairs of said guide rails;

a plurality of elongated menu strips having descriptive indicia thereon, each of said menu strips being disposed between and supported by a different one of said adjacent pairs of guide rails; and said removable and rotatable vertical frame section being selectively engageable and selectively disengageable with said top and bottom frame members such that said removable and rotatable vertical frame section, in an engaged position with said top and bottom frame members, overlies respective ends of said guide rails positioned in said locating pockets along said one of said first and second vertical side frame members so as to retain said guide rails in said locating pockets and, in a disengaged position with said top and bottom frame members, permits removal of said guide rails from said locating pockets.

23. The adjustable menu panel of claim 22 wherein each of said first and second vertical side frame members and said pair of track members has cooperating mating structure so as to retain said track members on said respective first and second vertical side frame members.

24. The adjustable menu panel of claim 22 wherein said removable and rotatable vertical frame section is pivotally connected to said top and bottom frame members.

25. The adjustable menu panel of claim 24 wherein said removable and rotatable vertical frame section is pivotal between open and closed positions, said removable and rotatable vertical frame section, in the open position, permitting insertion of said menu strips between adjacent pairs of said guide rails and, in the closed position, retaining said menu strips between said adjacent pairs of guide rails.

26. The adjustable menu panel of claim 25 further composing a locking clip selectively engageable and disengageable with said frame and said removable and rotatable vertical frame section, said locking clip, in an engaged position, locking said removable and rotatable vertical frame section in the closed position and, in a disengaged position, permitting pivotal movement of said removable and rotatable vertical frame section to the open position.

27. The adjustable menu panel of claim 25 further comprising a first locking member pivotally connected to said frame and selectively pivotable between locked and unlocked positions, said first locking member, in the locked position, engaging said removable and rotatable vertical frame section to lock said removable and rotatable vertical frame section in the closed position and, in the unlocked position, permitting pivotal movement of said removable and rotatable vertical frame section to the open position.

28. The adjustable menu panel of claim 22 further comprising:

an aperture formed in one of said top and bottom frame members;

a slot formed in the other of said top and bottom frame members; and a pin extending outwardly from each end of said removable and rotatable vertical frame section, each of said pins engaging one of said aperture and said slot when said removable and rotatable vertical frame section is selectively engaged with said top and bottom frame members in the engaged position.

29. The adjustable menu panel of claim 28 further comprising:

a second locking member connected to said frame and selectively engageable with one of said pins when said removable and rotatable vertical frame section is selectively engaged with said top and bottom frame members so as to retain said removable and rotatable vertical frame section in the engaged position.

30. The adjustable menu panel of claim 29 wherein said second locking member comprises a flexible leaf spring.

31. The adjustable menu panel of claim 22 further comprising: a first aperture formed in said top frame member;

a second aperture formed in said bottom frame member;

a pin extending outwardly from each end of said removable and rotatable vertical frame section, each of said pins engaging one of said first and second apertures when said removable and rotatable vertical frame section is engaged with said top and bottom frame members in the engaged position.

32. The adjustable menu panel of claim 22 wherein said guide rails are slotted longitudinally to slidably receive opposite longitudinal edges of one of said menu strips between an adjacent pair of said guide rails.

33. An adjustable menu panel, comprising:

an assembled frame having a top frame member, a bottom frame member and first and second vertical side frame members extending in spaced relationship between said top and bottom frame members, one of said first and second vertical side frame members having a stationary vertical frame section and a removable and rotatable vertical frame section disposed adjacent said stationary vertical frame section;

a pair of elongated track members, each of said track members being mounted on a respective one of said first and second vertical side frame members and having a plurality of guide rail locating elements disposed vertically along the length of each track member, each adjacent pair of said guide rail locating elements defining a locating pocket therebetween;

a plurality of generally parallel guide rails selectively positionable in said locating pockets at opposite ends of said guide rails, said guide rails thereby being selectively positionable in said locating pockets at regularly and variably spaced locations vertically along said first and second vertical side frame members to provide the same and different spacing between adjacent pairs of said guide rails, said guide rails being configured to receive and retain a menu strip having descriptive indicia thereon between an adjacent pair of said guide rails; and said removable and rotatable vertical frame section being selectively engageable and selectively disengageable with said top and bottom frame members such that said removable and rotatable vertical frame section, in an engaged position with said top and bottom frame members, overlies respective ends of said guide rails positioned in said locating pockets along said one of said first and second vertical side frame members so as to retain said guide rails in said locating pockets and, in a disengaged position with said top and bottom frame members, permits removal of said guide rails from said locating pockets.

34. The adjustable menu panel of claim 33 wherein each of said first and second vertical side frame members and said pair of track members has cooperating mating structure so as to retain said track members on said respective first and second vertical side frame members.

35. The adjustable menu panel of claim 33 wherein said removable and rotatable vertical frame section is pivotally connected to said top and bottom frame members.

36. The adjustable menu panel of claim 35 wherein said removable and rotatable vertical frame section is pivotal between open and closed positions, said removable and rotatable vertical frame section, in the open position, permitting insertion of the menu strips between adjacent pairs of said guide rails and, in the closed position, retaining the menu strips between said adjacent pairs of guide rails.

37. The adjustable menu panel of claim 36 further composing a locking clip selectively engageable and disengageable with said frame and said removable and rotatable vertical frame section, said locking clip, in an engaged position, locking said removable and rotatable vertical frame section in the closed position and, in a disengaged position, permitting pivotal movement of said removable and rotatable vertical frame section to the open position.

38. The adjustable menu panel of claim 36 further comprising a first locking member pivotally connected to said frame and selectively pivotable between locked and unlocked positions, said first locking member, in the locked position, engaging said removable and rotatable vertical frame section to lock said removable and rotatable vertical frame section in the closed position and, in the unlocked position, permitting pivotal movement of said removable and rotatable vertical frame section to the open position.

39. The adjustable menu panel of claim 33 further comprising:

an aperture formed in one of said top and bottom frame members;

a slot formed in the other of said top and bottom frame members; and a pin extending outwardly from each end of said removable and rotatable vertical frame section, each of said pins engaging one of said aperture and said slot when said removable and rotatable vertical frame section is selectively engaged with said top and bottom frame members in the engaged position.

40. The adjustable menu panel of claim 39 further comprising:

a second locking member connected to said frame and selectively engageable with one of said pins when said removable and rotatable vertical frame section is selectively engaged with said top and bottom frame members so as to retain said removable and rotatable vertical frame section in the engaged position.

41. The adjustable menu panel of claim 40 wherein said second locking member comprises a flexible leaf spring.

42. The adjustable menu panel of claim 33 further comprising:

a first aperture formed in said top frame member;

a second aperture formed in said bottom frame member;

a pin extending outwardly from each end of said removable and rotatable vertical frame section, each of said pins engaging one of said first and second apertures when said removable and rotatable vertical frame section is engaged with said top and bottom frame members in the engaged position.

43. The adjustable menu panel of claim 33 wherein said guide rails are slotted longitudinally to slidably receive opposite longitudinal edges of one of the menu strips between an adjacent pair of said guide rails.

* * * * *